US011721206B2

(12) United States Patent
Mubarek

(10) Patent No.: US 11,721,206 B2
(45) Date of Patent: Aug. 8, 2023

(54) METHOD, APPARATUS, AND SYSTEM FOR AUTOMATIC VERIFICATION OF ROAD CLOSURE REPORTS

(71) Applicant: HERE GLOBAL B.V., Eindhoven (NL)

(72) Inventor: Omer Mubarek, Chicago, IL (US)

(73) Assignee: HERE Global B.V., Eindhoven (NL)

( * ) Notice: Subject to any disclaimer, the term of this patent is extended or adjusted under 35 U.S.C. 154(b) by 166 days.

(21) Appl. No.: 17/240,625

(22) Filed: Apr. 26, 2021

(65) Prior Publication Data

US 2021/0256838 A1 Aug. 19, 2021

Related U.S. Application Data

(63) Continuation of application No. 16/155,613, filed on Oct. 9, 2018, now Pat. No. 11,004,334.

(51) Int. Cl.
*G08G 1/01* (2006.01)
*G08G 1/052* (2006.01)

(52) U.S. Cl.
CPC ..... *G08G 1/0133* (2013.01); *G08G 1/0112* (2013.01); *G08G 1/052* (2013.01)

(58) Field of Classification Search
USPC ..... 701/118
See application file for complete search history.

(56) References Cited

U.S. PATENT DOCUMENTS 7,246,007 B2 * 7/2007 Ferman ..... G08G 1/127 701/119
7,447,588 B1 * 11/2008 Xu ..... G08G 1/0104 340/995.13
7,623,963 B2 * 11/2009 Nomura ..... G01C 21/3415 701/417
8,731,808 B2 5/2014 Tashiro et al.
9,091,561 B1 * 7/2015 Weir ..... G01C 21/3484
9,361,797 B1 * 6/2016 Chen ..... G08G 1/0141
9,401,086 B2 * 7/2016 Basalamah ..... G08G 1/0112
9,696,169 B2 * 7/2017 Johnson ..... G01C 21/3461
9,761,137 B2 * 9/2017 Beaurepaire ..... G01C 21/3415
(Continued)

FOREIGN PATENT DOCUMENTS

WO 2017009466 A1 1/2017

OTHER PUBLICATIONS

Wang et al., "Road Traffic Anomaly Detection via Collaborative Path Inference from GPS Snippets", Article, Published in Sensors, Mar. 9, 2017, pp. 1-21.

*Primary Examiner* — Jonathan M Dager
(74) *Attorney, Agent, or Firm* — Ditthavong, Steiner & Mlotkowski

(57) ABSTRACT

An approach is provided for automatically verifying a road closure report. The approach, for example, involves determining one or more features of probe data collected from a plurality of vehicles traveling on a connected set of road links of a closure link graph. The closure link graph, for instance, comprises a road link indicated by the road closure report, one or more upstream links from the road link, one or more downstream links from the road link, or a combination thereof. The approach also involves evaluating a closure probability of the road link indicated by the road closure report based on the one or more features. The road closure report is then automatically verified based on the closure probability.

20 Claims, 15 Drawing Sheets

(56) References Cited

U.S. PATENT DOCUMENTS 9,805,598 B2 * 10/2017 Ishikawa ..... G08G 1/09
9,818,295 B2 11/2017 Kesting et al.
10,192,432 B2 * 1/2019 Lorkowski ..... G08G 1/0112
10,378,908 B2 * 8/2019 Dorum ..... G01C 21/32
10,497,256 B1 * 12/2019 Mubarek ..... G01C 21/3841
10,657,807 B1 * 5/2020 Sheynman ..... G08G 1/0112
11,386,068 B2 * 7/2022 Giurgiu ..... G01C 21/32
11,468,768 B2 * 10/2022 Mubarek ..... G08G 1/012
2006/0058941 A1 * 3/2006 DeKock ..... G08G 1/096758 340/933
2013/0030690 A1 * 1/2013 Witmer ..... G01C 21/3811 701/409
2013/0214939 A1 * 8/2013 Washlow ..... G01S 7/022 340/901
2013/0345955 A1 * 12/2013 Tashiro ..... G08G 1/0112 701/118
2014/0132608 A1 * 5/2014 Mund ..... G06T 11/206 345/440
2014/0278055 A1 * 9/2014 Wang ..... G01C 21/3819 701/409
2015/0051822 A1 * 2/2015 Joglekar ..... G08G 1/0145 701/118
2015/0170514 A1 * 6/2015 Stenneth ..... G08G 1/0125 701/117
2015/0221216 A1 * 8/2015 Stenneth ..... G08G 1/0133 701/117
2015/0300835 A1 * 10/2015 Fowe ..... G08G 1/012 701/410
2016/0033298 A1 * 2/2016 Duan ..... G01C 21/3691 701/533
2016/0247397 A1 * 8/2016 Xu ..... G08G 1/0125
2016/0275787 A1 * 9/2016 Kesting ..... G08G 1/0112
2016/0321919 A1 * 11/2016 Xu ..... H04W 4/027
2016/0358468 A1 * 12/2016 McGavran ..... G01C 21/3691
2017/0116852 A1 4/2017 Xu et al.
2017/0322035 A1 * 11/2017 Dorum ..... G01C 21/30
2018/0202816 A1 * 7/2018 Kesting ..... G08G 1/0141
2018/0240026 A1 * 8/2018 Pietrobon ..... G08G 1/0112
2018/0276988 A1 * 9/2018 Littlejohn ..... G08G 1/04
2018/0376305 A1 * 12/2018 Ramalho de Oliveira ..... H04W 4/44
2019/0156664 A1 * 5/2019 Yamada ..... G08G 1/0129
2020/0025584 A1 * 1/2020 Fowe ..... G01C 21/3492
2020/0090503 A1 * 3/2020 Rolf ..... G08G 1/0116
2020/0105134 A1 * 4/2020 Pietrobon ..... G01C 21/3841
2020/0111357 A1 * 4/2020 Mubarek ..... G08G 1/096766
2020/0200543 A1 * 6/2020 Mubarek ..... G01C 21/3867
2020/0202708 A1 * 6/2020 Fowe ..... G08G 1/0133
2020/0211385 A1 * 7/2020 Johnson ..... G08G 1/096708
2020/0273328 A1 * 8/2020 Mubarek ..... G01C 21/3492
2021/0150894 A1 * 5/2021 Mubarek ..... G08G 1/0129
2021/0157307 A1 * 5/2021 Fowe ..... G06Q 10/06395
2021/0241614 A1 * 8/2021 Mubarek ..... G08G 1/096827
2022/0084398 A1 * 3/2022 Zhang ..... G01C 21/3822
2022/0180099 A1 * 6/2022 Yadav ..... G06V 10/20

* cited by examiner

METHOD, APPARATUS, AND SYSTEM FOR AUTOMATIC VERIFICATION OF ROAD CLOSURE REPORTS

RELATED APPLICATION

This application is a continuation of U.S. patent application Ser. No. 16/155,613, filed Oct. 9, 2018, entitled "METHOD, APPARATUS, AND SYSTEM FOR AUTOMATIC VERIFICATION OF ROAD CLOSURE REPORTS", which is incorporated herein by reference in its entirety.

BACKGROUND

Providing data on traffic incidents (e.g., abnormalities in traffic that can affect traffic flow such as accidents, lane closures, road closures, etc.) is an important function for map service providers. In particular, while most traffic incidents can have at least some negative impact on traffic, road closures can be the most severe because no cars can go through the affected roadway. The lack of knowledge about a road closure can have enormous negative impact on trip planning, routing, and estimated time of arrival. Therefore, traffic service providers face significant technical challenge to reporting road closures accurately, particularly when road closures are reported from third parties such as government/municipality agencies, local police, crowd-sourced data, and/or any other official/semi-official sources.

SOME EXAMPLE EMBODIMENTS

Therefore, there is a need for automatically verifying a road closure report before, e.g., publishing the reports to end users.

According to one embodiment, a computer-implemented method comprises determining one or more features of probe data collected from a plurality of vehicles traveling on a connected set of road links of a closure link graph. The closure link graph comprises a road link indicated by the road closure report, one or more upstream links from the road link, one or more downstream links from the road link, or a combination thereof. The method also comprises evaluating a closure probability of the road link indicated by the road closure report based on the one or more features. The road closure report is automatically verified based on the closure probability.

According to another embodiment, an apparatus comprises at least one processor, and at least one memory including computer program code for one or more computer programs, the at least one memory and the computer program code configured to, with the at least one processor, cause, at least in part, the apparatus to determine one or more features of probe data collected from a plurality of vehicles traveling on a connected set of road links of a closure link graph. The closure link graph comprises a road link indicated by the road closure report, one or more upstream links from the road link, one or more downstream links from the road link, or a combination thereof. The apparatus is also caused to evaluate a closure probability of the road link indicated by the road closure report based on the one or more features. The road closure report is automatically verified based on the closure probability.

According to another embodiment, a non-transitory computer-readable storage medium carries one or more sequences of one or more instructions which, when executed by one or more processors, cause, at least in part, an apparatus to determine one or more features of probe data collected from a plurality of vehicles traveling on a connected set of road links of a closure link graph. The closure link graph comprises a road link indicated by the road closure report, one or more upstream links from the road link, one or more downstream links from the road link, or a combination thereof. The apparatus is also caused to evaluate a closure probability of the road link indicated by the road closure report based on the one or more features. The road closure report is automatically verified based on the closure probability.

According to another embodiment, an apparatus comprises means for determining one or more features of probe data collected from a plurality of vehicles traveling on a connected set of road links of a closure link graph. The closure link graph comprises a road link indicated by the road closure report, one or more upstream links from the road link, one or more downstream links from the road link, or a combination thereof. The apparatus also comprises means for evaluating a closure probability of the road link indicated by the road closure report based on the one or more features. The road closure report is automatically verified based on the closure probability.

In addition, for various example embodiments of the invention, the following is applicable: a method comprising facilitating a processing of and/or processing (1) data and/or (2) information and/or (3) at least one signal, the (1) data and/or (2) information and/or (3) at least one signal based, at least in part, on (or derived at least in part from) any one or any combination of methods (or processes) disclosed in this application as relevant to any embodiment of the invention.

For various example embodiments of the invention, the following is also applicable: a method comprising facilitating access to at least one interface configured to allow access to at least one service, the at least one service configured to perform any one or any combination of network or service provider methods (or processes) disclosed in this application.

For various example embodiments of the invention, the following is also applicable: a method comprising facilitating creating and/or facilitating modifying (1) at least one device user interface element and/or (2) at least one device user interface functionality, the (1) at least one device user interface element and/or (2) at least one device user interface functionality based, at least in part, on data and/or information resulting from one or any combination of methods or processes disclosed in this application as relevant to any embodiment of the invention, and/or at least one signal resulting from one or any combination of methods (or processes) disclosed in this application as relevant to any embodiment of the invention.

For various example embodiments of the invention, the following is also applicable: a method comprising creating and/or modifying (1) at least one device user interface element and/or (2) at least one device user interface functionality, the (1) at least one device user interface element and/or (2) at least one device user interface functionality based at least in part on data and/or information resulting from one or any combination of methods (or processes) disclosed in this application as relevant to any embodiment of the invention, and/or at least one signal resulting from one or any combination of methods (or processes) disclosed in this application as relevant to any embodiment of the invention.

In various example embodiments, the methods (or processes) can be accomplished on the service provider side or on the mobile device side or in any shared way between service provider and mobile device with actions being performed on both sides.

For various example embodiments, the following is applicable: An apparatus comprising means for performing a method of the claims.

Still other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The embodiments of the invention are illustrated by way of example, and not by way of limitation, in the figures of the accompanying drawings.

DESCRIPTION OF SOME EMBODIMENTS

Examples of a method, apparatus, and computer program for automatically verifying road closure reports are disclosed. In the following description, for the purposes of explanation, numerous specific details are set forth in order to provide a thorough understanding of the embodiments of the invention. It is apparent, however, to one skilled in the art that the embodiments of the invention may be practiced without these specific details or with an equivalent arrangement. In other instances, well-known structures and devices are shown in block diagram form in order to avoid unnecessarily obscuring the embodiments of the invention.

Figure 1:
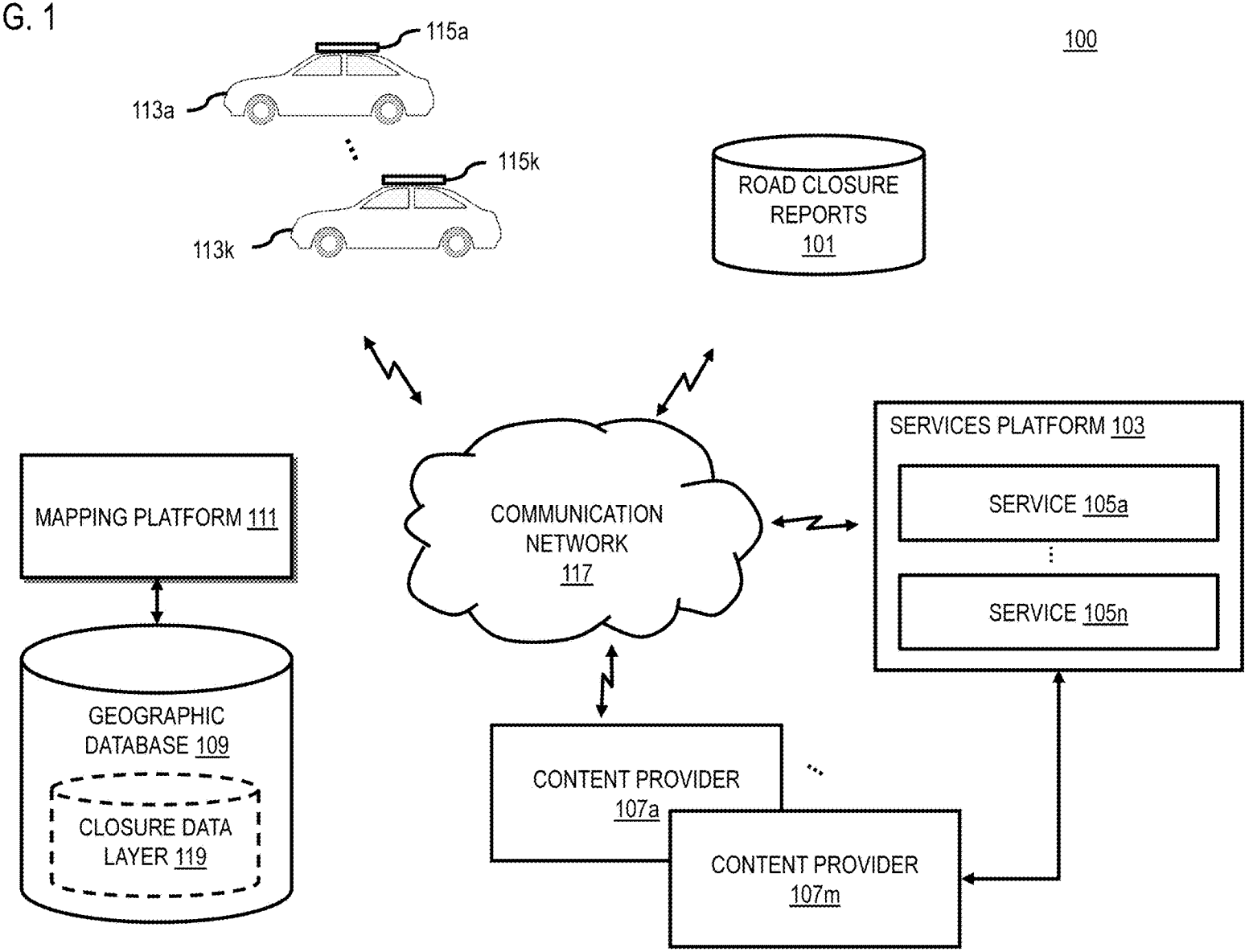
FIG. 1 is a diagram of a system capable of automatically verifying road closure reports, according to one embodiment.

FIG. 1 is a diagram of a system 100 capable of automatically verifying road closure reports, according to one embodiment. Generally, traffic incidents such as road closures (e.g., road closure reports 101) are published by government/municipality agencies, local police, and/or third-party official/semi-official sources (e.g., a services platform 103, one or more services 105*a*-105*n*, one or more content providers 107*a*-107*m*, etc.). By way of example, the published road closure reports 101 can specify the roadway (e.g., by name or matched to specific road link records of digital map data such as a geographic database 109) that has been closed or partially closed to traffic (e.g., vehicular and/or non-vehicular traffic). Closure refers, for instance, to restricting traffic flow on a particular roadway such that no vehicle or a reduced number of vehicle (e.g., reduced with respect to an average free flow traffic volume on the roadway) is permitted or able to travel on the roadway. In one embodiment, a traffic provider (e.g., via a mapping platform 111) monitors the feeds of the road closures reports 101, extracts the affected roadways, and provides traffic data and/or other functions based on the road closure reports 101 (e.g., displays the location of reported closures on the map, generates navigation routes to avoid reported road closures, etc.). Then, traditional traffic service providers wait for another message or road closure report 101 indicating that the road has opened to provide updated data and/or functions. In other words, traditional traffic service providers have historically placed total reliance on these road closure reports 101.

However, several potential issues can arise from this over reliance on road closure reports 101 and result in providing poor quality data and/or poor user experiences for users of the traffic service. For example, the road closure report 101 could be wrong; i.e., the reported road segment is actually not closed. In another scenario, the road closure report 101 might be inaccurate in time and/or location. For example, the road closure report 101 may have been based on a construction-scheduled closure with predetermined start and end times. However, the scheduled closure may have started and/or ended at a different time than specified in the schedule. In yet another scenario, the road closure report 101 could be due to an unscheduled event, and the provider or source of the report 101 could be very late to publish the expiration of the closure event, or miss publishing the expiration of the closure (e.g., the re-opening of the road) completely.

In such cases, users of a traffic service that relies on problematic data can suffer from unexpected delays, reroutes, etc. As a result, users may gradually lose their trust in the service if such events occur frequently. To minimize this risk, traffic service providers have traditionally deployed human resources to monitor closures from multiple sources and to report incidents accurately. However, human or manual monitoring and verification can be resource intensive and may not scale well. For example, as the number of incidents or closures increase (e.g., with increased coverage area), so does the labor cost and chances for human errors. Therefore, traffic service providers face significant technical challenges to reducing manual resources needed for human-based verification of road closure reports 101.

To address this problem, the system 100 introduces a capability to build a connected roadway network around a reported closure, e.g., referred to as roadway graph or a closure link graph (e.g., a mathematical graph) henceforth. In one embodiment, the system 100 then uses probe data collected from vehicles 113*a*-113*k* (also collectively referred to as vehicles 113) to produce vehicle paths. By way of example, the probe data can include, at least in part, location data sampled from the respective location sensors 115*a*-115*k* (also collectively referred to sensors 115, such as GPS sensors, compasses, accelerometers, gyroscopes, etc.). The calculated vehicle paths are then mapped onto the roadway graph or closure link graph. In one embodiment, the system 100 then calculates a number of features derived from the probe data to be used for deciding or verifying whether a road segment of interest is closed/open or other affected for a traffic incident or anomaly. In other words, the system 100 uses the calculated features of the probe data to evaluate the closure probability of the road segment. This evaluation includes, for instance, comparing the calculated probability against corresponding threshold values to determine whether a road segment is closed, open, and/or partially closed.

In one embodiment, the features derived from the probe data relate to characterizing whether vehicles are traveling through and/or detouring around the closure link graph or any links contained therein. However, because probe data is traditionally sampled at relatively low frequencies, data sparseness across road links of the closure link graph can present technical challenges to accurately deriving the features. To address these additional technical challenges, the system 100 further introduces a capability to use path-based map-matching to the closure link graphs to derive features such as, but not limited to: (1) the total number of vehicles passing through each given link of the closure link graph, (2) expected number vehicles passing through each given link, (3) number of vehicles detouring around or avoiding a given link in the closure link graph, (4) historical confidence levels in the source of closure reports, (5) features related to temporal variances in probe data, (6) features related to spatial variances or relationships in the probe data, etc. The system 100 can then process the derived features (e.g., using rules and/or other algorithmic processes) to determine the probability that a road segment exhibiting the derived features is closed, open, partially opened, and/or otherwise affected by a traffic incident or anomaly.

Figure 2:
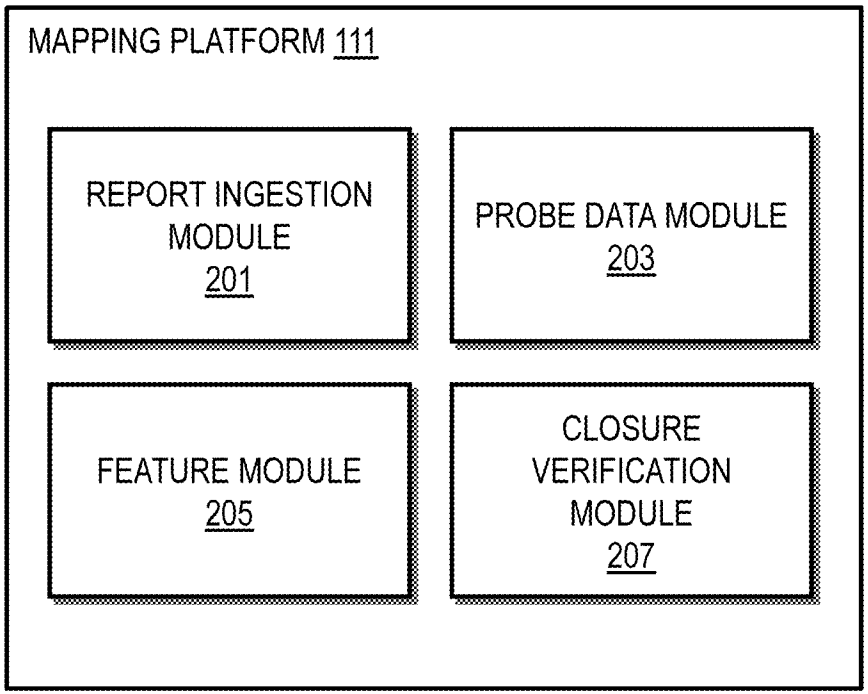
FIG. 2 is a diagram of the components of a mapping platform configured to verify road closure reports, according to one embodiment.

In one embodiment, the system 100 includes a mapping platform 111 that includes one or more components for automatically verifying road closure reports according to the various embodiments described herein as shown in FIG. 2. It is contemplated that the functions of these components may be combined or performed by other components of equivalent functionality. As shown, in one embodiment, the mapping platform 111 includes a report ingestion module 201, a probe data module 203, a feature module 205, and a closure verification module 207. The above presented modules and components of the mapping platform 111 can be implemented in hardware, firmware, software, or a combination thereof. Though depicted as a separate entity in FIG. 1, it is contemplated that the mapping platform 111 may be implemented as a module of any of the components of the system 100 (e.g., a component of the vehicle 113, services platform 103, services 105*a*-105*n* (also collectively referred to as services 105), etc.). In another embodiment, one or more of the modules 201-207 may be implemented as a cloud-based service, local service, native application, or combination thereof. The functions of the mapping platform 111 and modules 201-207 are discussed with respect to FIGS. 3-12 below.

Figure 3:
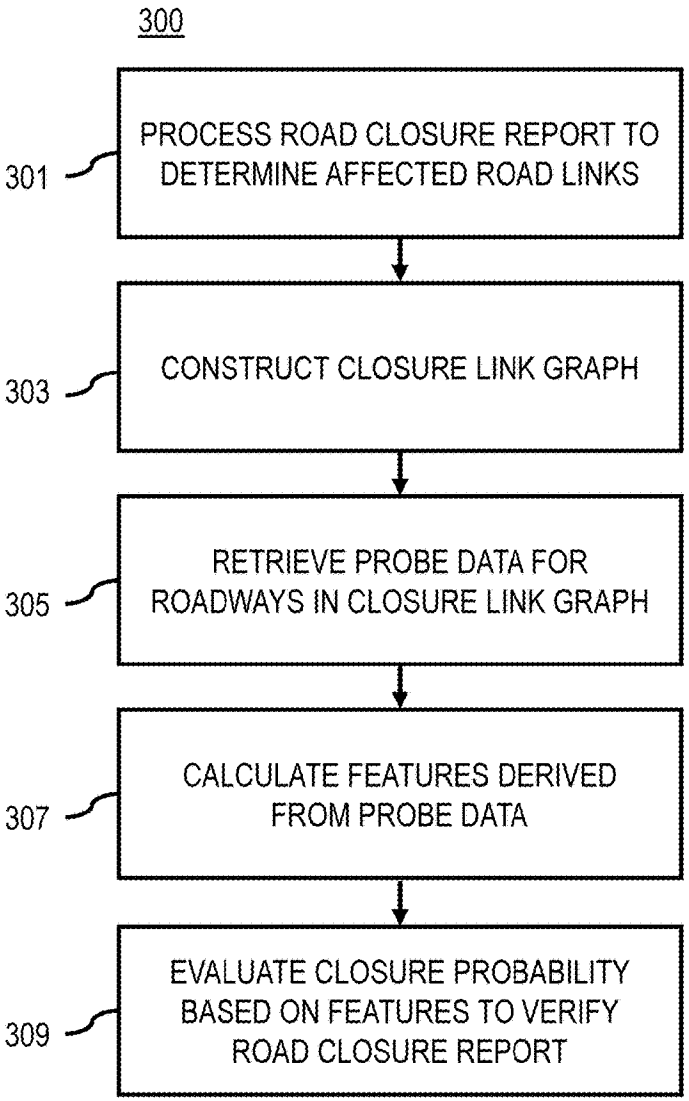
FIG. 3 is a flowchart of a process for automatically verifying road closure reports, according to one embodiment.
Figure 15:
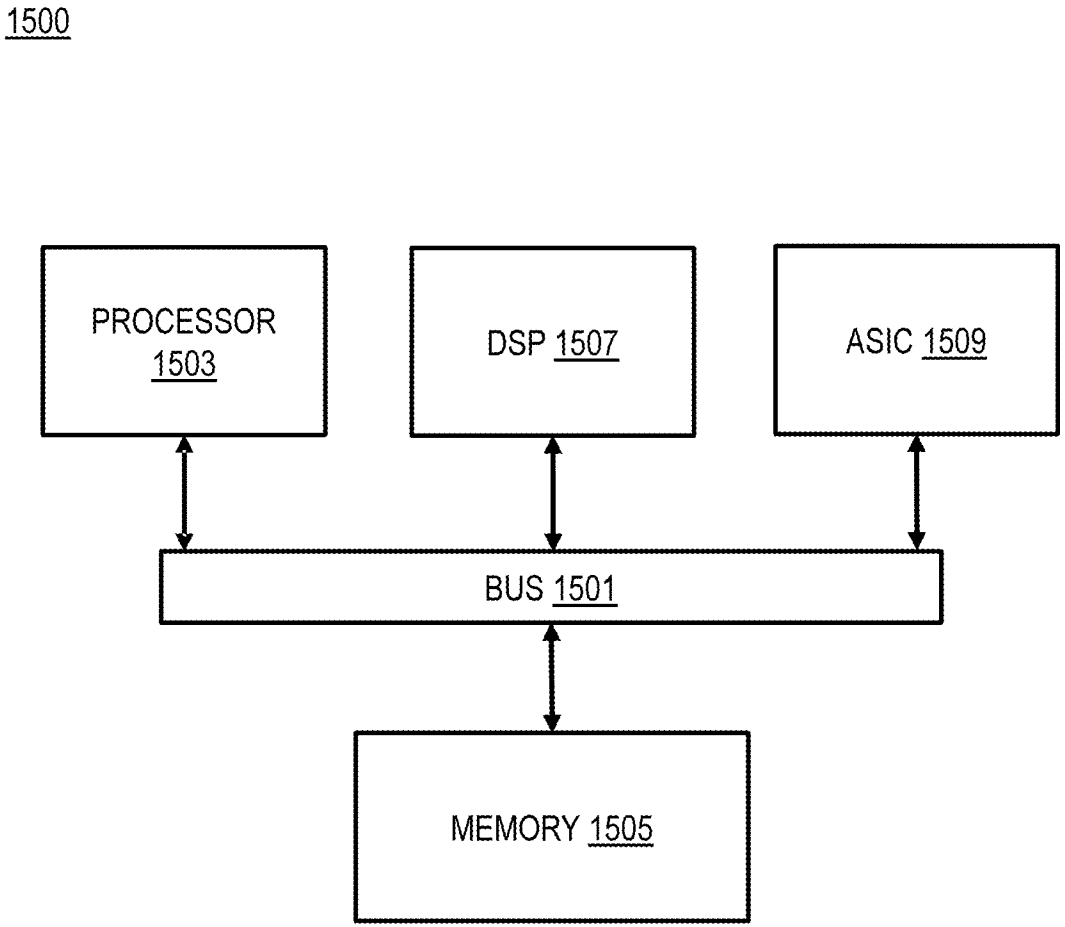
FIG. 15 is a diagram of a chip set that can be used to implement an embodiment.

FIG. 3 is a flowchart of a process for automatically verifying road closure reports, according to one embodiment. In various embodiments, the mapping platform 111 and/or any of the modules 201-207 may perform one or more portions of the process 300 and may be implemented in, for instance, a chip set including a processor and a memory as shown in FIG. 15. As such, the mapping platform 111 and/or any of the modules 201-207 can provide means for accomplishing various parts of the process 300, as well as means for accomplishing embodiments of other processes described herein in conjunction with other components of the system 100. Although the process 300 is illustrated and described as a sequence of steps, it is contemplated that various embodiments of the process 300 may be performed in any order or combination and need not include all of the illustrated steps.

In step 301, the report ingestion module 201 receives and/or processes one or more road closure reports 101 to determine road links affected by or otherwise associated with a reported road closure. As described above, a road closure report 101 is any message or data record originating or transmitted from a road closure source (e.g., a government/municipality agency, police agency, third-party sources, etc.). It is contemplated that the road closure report 101 can be transmitted in any format known in the art and includes data indicating a location or roadway affected by a road closure. The data can include a direct indication of the affected link (e.g., by specifying the link IDs corresponding to the roadway or segments affected by the reported road closure), or an indirect indication (e.g., address or offset location that can then be map-matched or translated to corresponding links of the geographic database 109).

In step 303, the report ingestion module 201 then constructs a closure link graph comprising a connected set of links including the road links indicated in the processed road closure report 101. In one embodiment, a road link is the unit representation of a roadway in a digital map such as the geographic database 109. Additional description of a link data record is described below with respect to FIG. 13. Generally, a roadway between two consecutive intersections can be represented by one or more links. However, a single link does not span more than the distance between two intersections.

Figure 4:
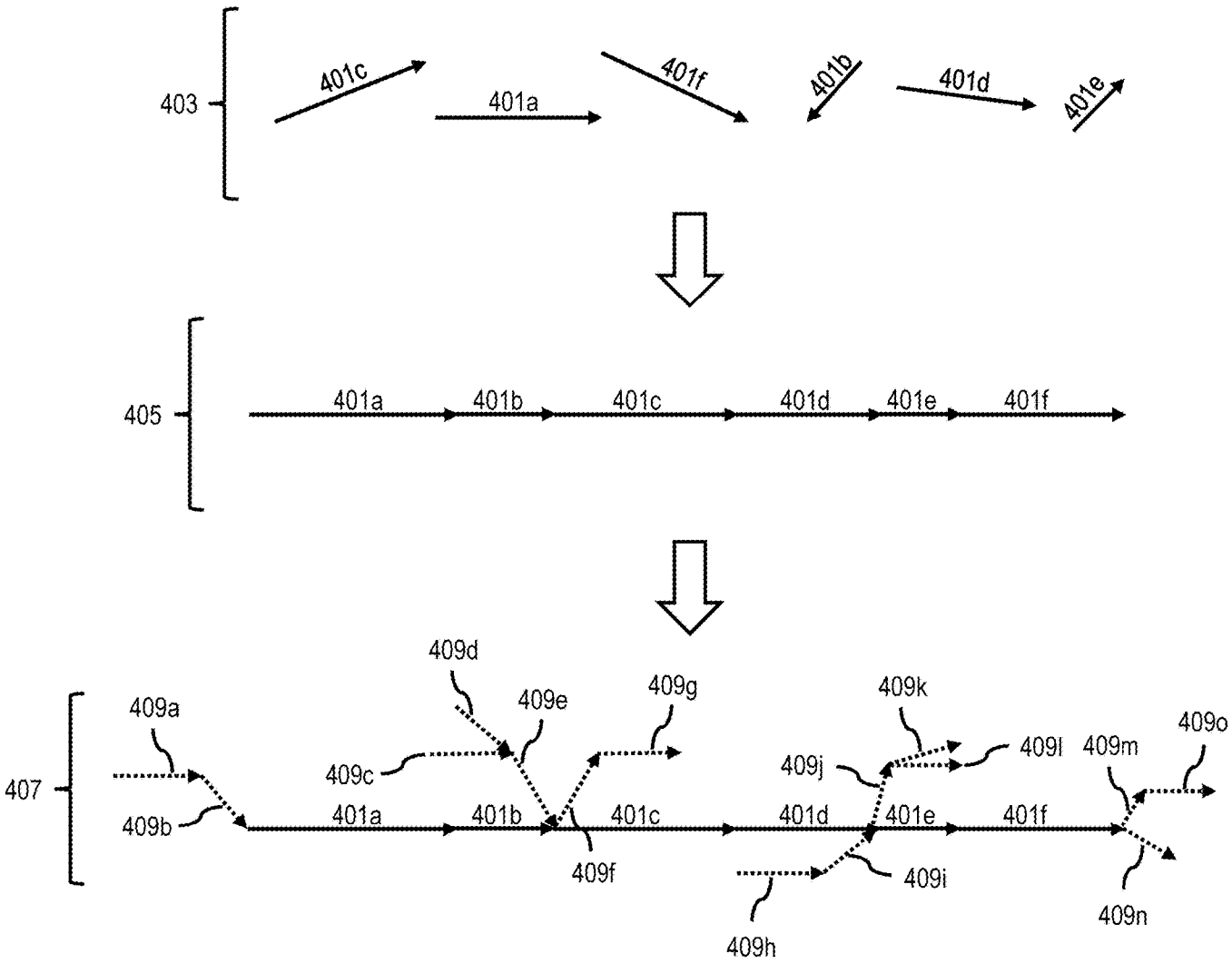
FIG. 4 is a diagram of illustrating an example of constructing a closure link graph, according to one embodiment.

In one embodiment, the closure link graph is used to seal or designate the reported closure area and monitor traffic around and through the closure within the area represented by the closure link graph. As described above, a closure incident is reported on a stretch of roadway (e.g., via a road closure report 101). This closure report 101 is then converted into a set of links. As shown in FIG. 4, these links (e.g., links 401*a*-401*f*, also collectively referred to as links 401) can be and unordered set 403 (e.g., unordered with respect to a spatial arrangement).

If the links 401 are unordered, the report ingestion module 201 initiates the building of the closure link graph around these links 401 by ordering the links 401 so that the end of one link is arranged to match the beginning of the next closest link based on the respective locations of their beginning and end nodes. The ordered set 405 of the links 401 is also illustrated in FIG. 4. The ordered set 405 of the links 401 corresponds to the abstract representation of the physical structure road segments making up the roadway indicated in the processed road closure report 101.

Next, the report ingestion module 201 adds links upstream to and downstream from the reported closures to construct the closure link graph 407. Since these links (e.g., links 409*a*-409*o*, also collectively referred to as links 409) are not among the original links 401 identified in the processed road closure report 101, the links 409 are assumed to be open and not closed to traffic. The resulting the closure link graph 407 then includes the reportedly closed links 401 buffered by links 409 that are open for travel. In other words, with the addition of open upstream and downstream links 409, the closure (e.g., on links 401) is now isolated. For example, given the closure links 401, all traffic going into and out of the closure region can be monitored using the traffic flowing in the open links 409.

In one embodiment, the flow of traffic is determined by collecting probe data from vehicles. For example, in step 305, the probe data module 203 retrieves probe data collected from vehicles traveling on the roadways corresponding to the closure link graph 407. In one embodiment, probe data includes raw GPS probes (e.g., probe points) sent from vehicles indicating their respective locations by, for instance, a latitude and longitude pair. Then, each probe point is placed onto most probable link on the map using any map matching process known in art. On example map-matching process works as described in the following section. A map is defined by a set of links and their geographic coordinates. Because GPS (or other similar location positioning technology) is not 100% accurate, the coordinates of a vehicle GPS probe most of the time do not fall onto a link perfectly. To account for this error, map matching algorithms take the coordinate of a GPS probe, and find the neighboring links whose coordinates are close to the probe. Then, the map matching process places the vehicle probe onto the most probable link based on pre-defined criteria based on the specific map matching process or algorithm being used.

In one embodiment, to better control for map matching error, the probe data module 203 described herein work with vehicle paths instead of map matched vehicle probes. The reason is that map matched vehicle probes can be more are susceptible to map matching errors than vehicle paths. By way of example, a vehicle path or trajectory is derived from two consecutive map matched vehicle probes. The path can then be increased by adding new probe points on top of the previously calculated vehicle path as new probe points are collected.

In one embodiment, the probe data module 203 can process the probe data to calculate vehicle paths traversing the monitored closure link graph 407 according to the example process described below. Firstly, for a specific vehicle, the probe data module 203 takes the first and second probe points received, e.g., denoted as probe1 and probe2. If the time difference between these probes is more than a specified threshold, the probe data module 203 discards the initial probe1, and the sets probe1=probe2. The probe data module 203 then retrieves the next probe point to set as probe 2 to iteratively evaluate the time difference.

If the time difference is less than the specified threshold, the probe data module 203 builds a vehicle path from probe1 to probe2. It is contemplated that the probe data module 203 can use any path building process or algorithm such as but not limited to A* pathfinding or equivalent. The probe data module 203 then records the new path for the vehicle, discards probe1, sets probe1=probe2, and retrieves the next probe point to act as probe2 until all probe points collected for the specific vehicle have been processed.

In one embodiment, every vehicle can send its probe points (e.g., GPS probes) at a different frequency; this frequency can vary from 1 second to a few minutes. Therefore, as a vehicle drives through multiple links, there is no guarantee that it will send a probe from every link. For instance, if a vehicle drives at fast speeds over short links while sending a probe every 2 minutes, it would almost be certain that its two consecutive probes will arrive from non-neighboring links. This sporadic or sparse probe reporting can make it more technically challenging to build accurate vehicle paths.

To address this technical challenge, in one embodiment, as part of its link graph building process, the report ingestion module 201 methodology can aggregate links and their probes where it makes sense into superlinks. In one embodiment, a superlink consists of ordered links such that if a vehicle travels through one of its links, it is guaranteed to travel through the other links of the same superlink as well. An example of a superlink is a section of a highway stretching between two entrance/exit ramps. When on this stretch a vehicle must go through all the links part when driving this stretch. Another example is a roadway between two intersections in a city road. Because a superlink comprises one or more links, superlinks are often longer than normal links of the geographic database 109, thereby increasing the probability that a probe point of a vehicle path would fall on the superlink than on a normal link. In addition, the superlinks can decrease the overall complexity of the closure link graph 407 without affecting the quality of the closure evaluation results, thereby reducing computing resources (e.g., processing resources, memory resources, bandwidth resources, etc.) associated with automatic evaluation of road closure reports according to the various embodiments described herein.

Figure 5:
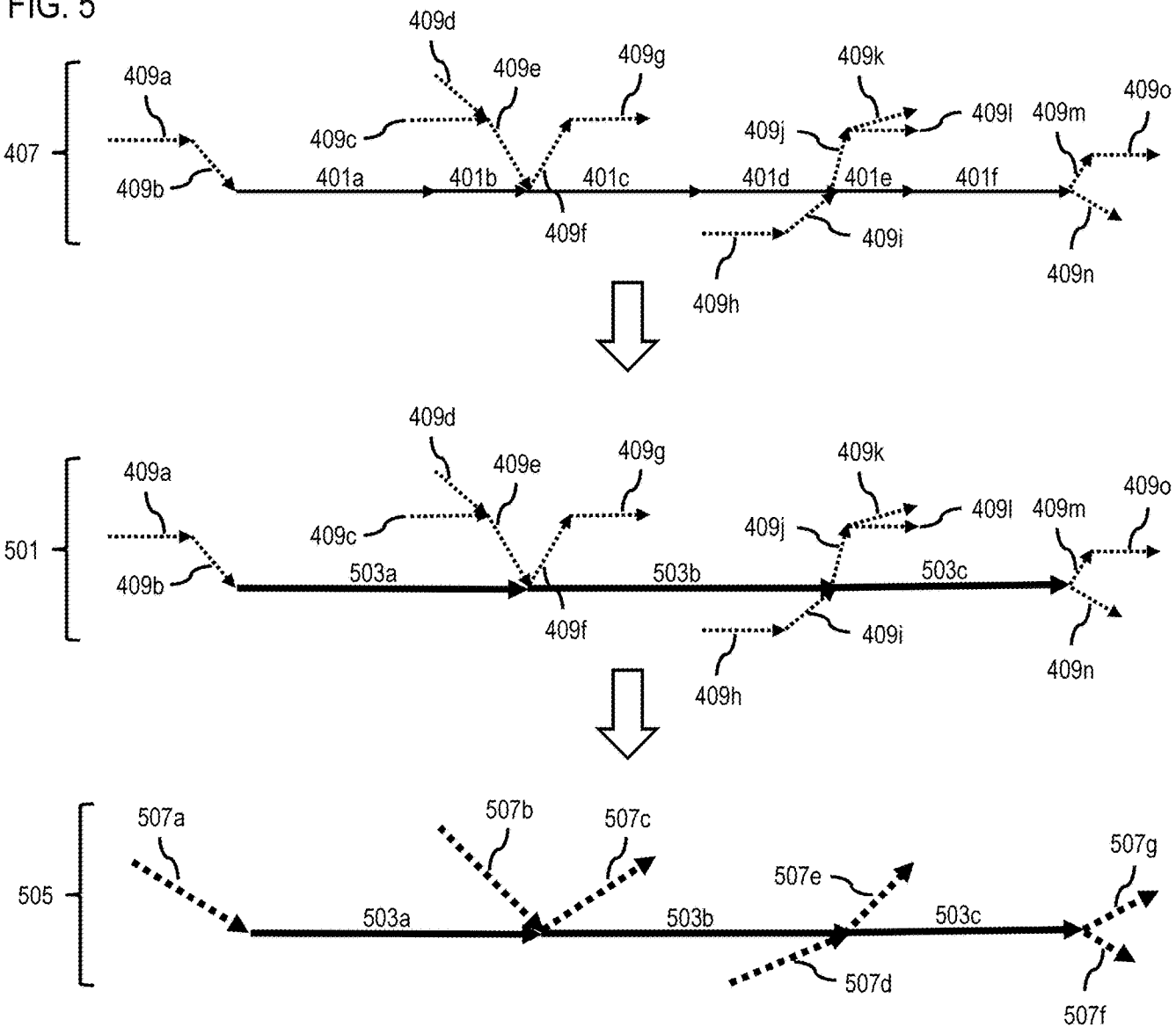
FIG. 5 is diagram of aggregating road links of a closure link graph into superlinks, according to one embodiment.

FIG. 5 is diagram of an example of aggregating road links of the closure link graph 407 into superlinks, according to one embodiment. FIG. 5 continues the example closure link graph 407 of FIG. 5 and illustrates a first superlink graph 501 that is a version of the closure link graph 407 in which the reportedly closed links 401 are aggregated into respective superlinks. In this example, links 401*a* and 401*b* can form a superlink 503*a* because a vehicle on link 401*a* must also travel through link 401*b*. Similarly, links 401*c* and 401*d* can be aggregated as superlink 503*b*, and links 401*e* and 401*f* can be aggregated into superlink 503*c*.

In one embodiment, the upstream and downstream links 409 can be aggregated into superlinks in addition to the links 401 to construct superlink graph 505. For example, links 409*a* and 409*b* can be aggregated into superlink 507*a*, links 409*c*-409*e* can be aggregated into superlink 507*b*, links 409*f* and 409*g* can be aggregated into superlink 507*c*, links 409*h* and 409*i* can be aggregated into superlink 507*d*, links 409*j*-4091 can be aggregated into superlink 507*e*, and links 409*m* and 4090 can be aggregated into superlink 507*g*. Referring for instance to the example of FIGS. 4 and 5, if a vehicle has probe points on link 401*a*, 401*c*, and 401*f*, the probe data module 203 can calculate the vehicle path to include links all links 401*a*-401*f* based on the superlinks 503*a*-503*c*.

In step 307, the feature module 205 then calculates a number of features derived from the probe data (e.g., GPS probe data) collected from the vehicles traveling on the connected set of road links of the closure link graph 407. As described above, the closure link graph 407 comprises the road link indicated in a road closure report being verified as well as one or more upstream and/or downstream links. In one embodiment, the features can include any characteristic, property, and/or attribute associated with the probe vehicles, road links on which the travel, and/or other related contextual attributes (e.g., time, location, spatial relationship between links, etc.) that can be determined based on the probe data of the closure link graph 407. Examples of calculating such features are discussed in more detail below.

One example of a feature relates to "through vehicles" associated with the road links of the closure link graph 407. This feature, for instance, is the total number of vehicles which passed through a given link or superlink of the closure link graph 407 in a given time epoch; e.g. every 5 minutes. In one embodiment, the feature module 205 can calculate the through vehicles feature as follows:

1. For the monitored set of links of the closure link graph 407 of interest, collect all vehicle probes (e.g., GPS probe points) within the specified time epoch or interval.
2. Group the collected probes by unique vehicle ID.
3. For each vehicle (e.g., as identified by the unique vehicle ID):
   3.1 Determine the vehicle's path either:
      3.1.1 Using a path-based mapmatcher to process the probe data for each vehicle; or
      3.1.2 Using a point-based mapmatcher combined with extra logic to correct mapmatching errors to process the probe data for each vehicle.
4. For all the links and/or superlinks included in the vehicle's path, increment the feature's value (e.g., increment by 1) to determine the total number of through vehicles passing through a road link in a given time epoch.

It is noted that this feature is different than GPS probe count on a link or superlink. For example, in contrast to a tradition probe count, a probe that is mis-mapmatched onto the link or superlink is not counted in this feature because the erroneous map-matching would be corrected by the path-based mapmatcher or the extra error correcting logic used in combination with the point-based mapmatching. By similar logic, a vehicle which has no GPS probes on a specific link or superlink would still be counted in this feature if its driving path passes through the link or superlink.

In one embodiment, the feature module 205 can also calculated an "expected through vehicles" feature, which can then be compared against the through vehicles feature calculated above to evaluate the closure probability of a road link of interest. The expected through vehicle feature, for instance, is the total number of vehicles expected to pass through a link or superlink for a given epoch (e.g. 5 minutes) so that the evaluation of the through vehicles feature to the expected through vehicles feature can be performed for each given time epoch. In one embodiment, the expected through vehicles feature is the summary statistics of the number of through vehicles for that specific time epoch over a historical period (e.g., the same time epoch over a number of days). There are different possibilities to calculate this value, such as but not limited to the following (note that as an example, it is assumed an epoch corresponds to 5-minutes, and there are 100 days-worth of historical data):

1. Over all epochs in a day, over all days, calculate average through vehicle value. There are 288 5-minute epochs per day. This embodiment of the feature averages all 288×100 through vehicle feature values.
2. Over all days, calculate an average through vehicle value for every specific 5-minute epoch in a day. Hence, there will be one value for the interval 00:00-00:05, another one for 00:05-00:10, . . . 23:55-00:00.
3. Calculate the same average as in item 2 above. In one embodiment, this can calculation can be stratified by time to capture differences in values between types of days (e.g., weekends versus weekdays). In this case, the expected through vehicles feature can be calculated twice; once for weekends, once for weekdays.
4. Calculate the same average as in item 2 above for each weekday, Monday through Sunday, to capture difference in values between individual days. Time stratifications other than days can also be used including but not limited to months, seasons, day versus night, etc.
5. Any approach from among items 1 to 4 above; but replace average with median or other equivalent statistic.

In one embodiment, the feature module 205 can also calculate a detouring vehicles feature. A very strong indicator of a closure are vehicles detouring or avoiding a given road segment. This feature calculates number of vehicles detouring around or avoiding a given link or superlink. For example, the detouring vehicles feature can be particularly suited for highways and highway like roads with exit/entry ramps or other entry/exit options to bypass a given road segment or link. In one embodiment, as shown in FIG. 6, a vehicle 113 is classified as detouring a certain link or superlink 601 if the vehicle 113 is on its way to the evaluated link/superlink 601, but changes its route away from that link/superlink 601, drives nearby and re-joins the road which is an extension or continuation of the evaluated link/superlink 601.

In one embodiment, having a closure link graph 407 that includes road links covering the full paths of all available detouring routes is ideal. However, providing closure link graphs 407 with full detouring paths is generally not scalable given current computational resources and constraints. This is because such graphs can require:

- having a very large closure link graph 407 that includes any possible detouring route for all links/superlinks;
- monitoring the possible routes and collecting vehicle probes; and
- building full paths from each exit to each downstream highway entrance.

Figure 6:
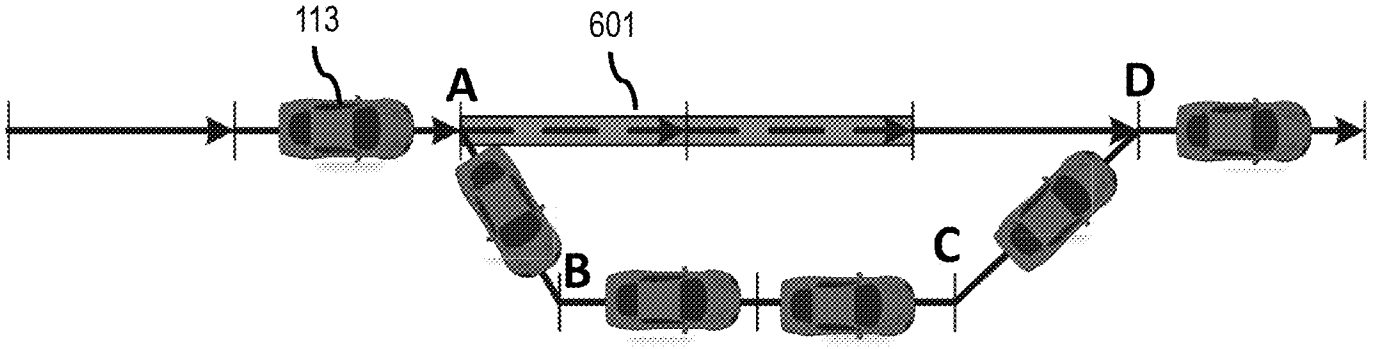
FIG. 6 is a diagram of an example of a full detouring path, according to one embodiment.

The complication arises because the portion of the links of the closure link graph between points B and C of the detouring path indicated in FIG. 6 can include one link/superlink, tens/hundreds of links, or any number of links. This open-ended nature of possible detouring routes can make finding a solution intractable and technically challenging. To address this technical problem, the feature module 205 can use a simplified version of the approach described above that omits the road segment(s) between points B and C. Specifically, as shown in FIG. 7, it can be enough to classify a vehicle as detouring a link/superlink 601 if it has probes:

- on a link/superlink 621 (e.g., an upstream link) before the evaluated link/superlink 601;
- on exit ramp 623 before the evaluated link/superlink 601;
- on an entry ramp 625 after the evaluated link/superlink 601; and/or
- on a link/superlink 627 (e.g., a downstream link) after the evaluated link/superlink 601.

Figure 7:
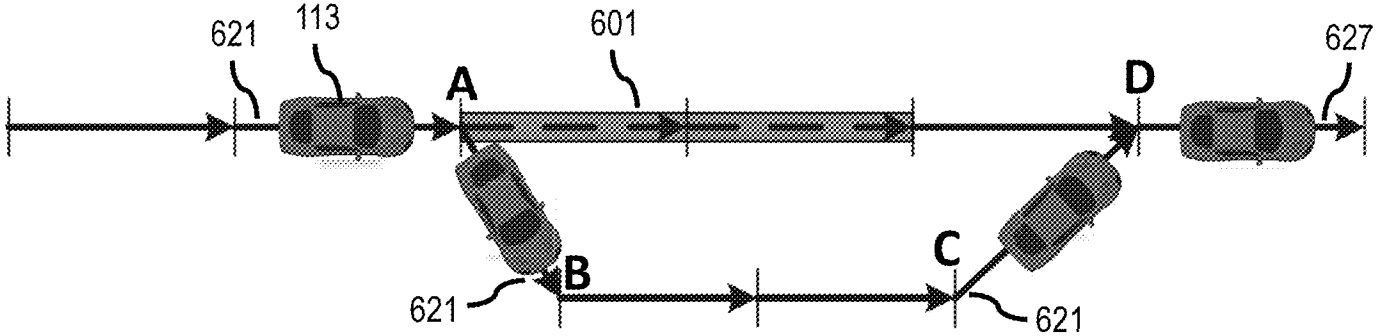
FIG. 7 is a diagram of an example of a simplified detouring path, according to one embodiment.

Note that between points B and C the vehicle is not visible as shown in FIG. 7, as that road segment is not part of the road network of the closure link graph 407 anymore. Hence, the links/superlinks in that section are not monitored, thereby advantageously reducing the resource burden associated with monitoring all road links of the detouring path.

For a given link/superlink, the best detouring option is sometimes not immediately before, but a few exits before. In this case, to capture detouring vehicles, the feature module 205 can construct a road closure link graph such that for any link/superlink to be evaluated, the graph would include at least x number of links/superlinks before/after and/or y kilometers of road before/after. Expanding the closure link graph in such a way can advantageously increase the probability that the closure link graph will include the entry and/or exit points of detouring paths.

Figure 8:
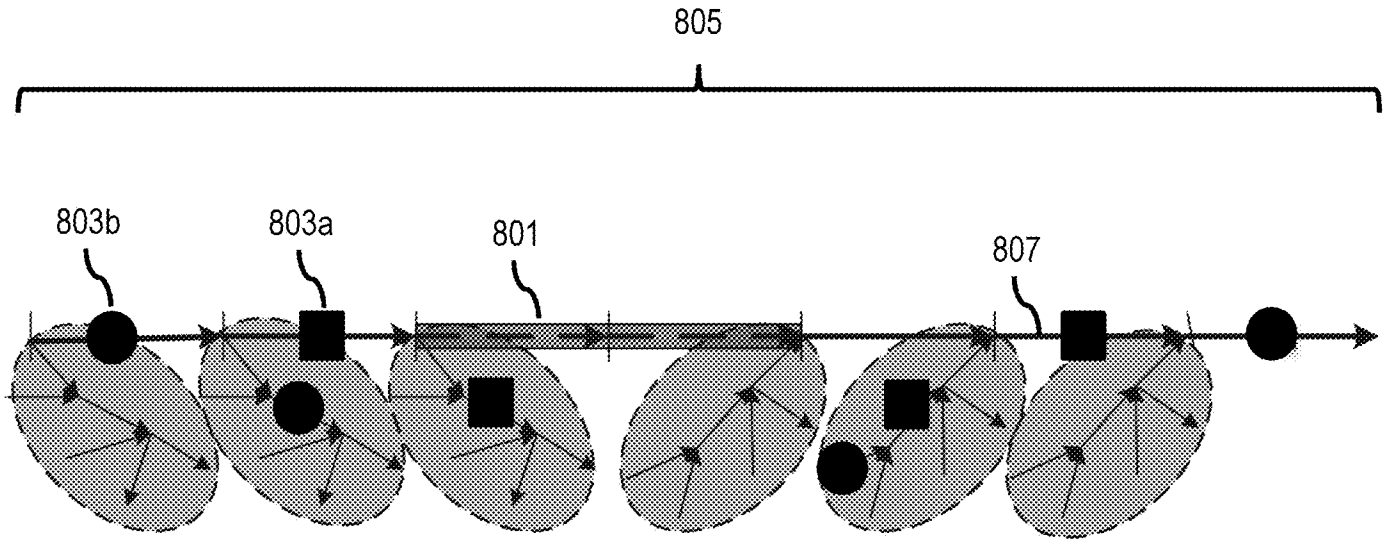
FIG. 8 is a diagram of an example road network with multiple exits used for detouring, according to one embodiment.

An example of this expanded closure link graph is illustrated in FIG. 8. As shown, the link/superlink 801 which is being evaluated is indicated by highlighting. A first vehicle 803*a* (represented by a solid square) exits the highway 805 immediately before the link/superlink 801. The vehicle 803*a* then rejoins the highway 805 one link/superlink 807 after the marked link/superlink 801. On the other hand, a second vehicle 803*b* (represented by solid circle) exits the highway 805 two exits before the evaluated link/superlink 801 and re-enters the highway 805 at the same point as vehicle 803*a*. Both vehicles 803*a* and 803*b* are counted as detouring the evaluated link/superlink 801.

Figure 9:
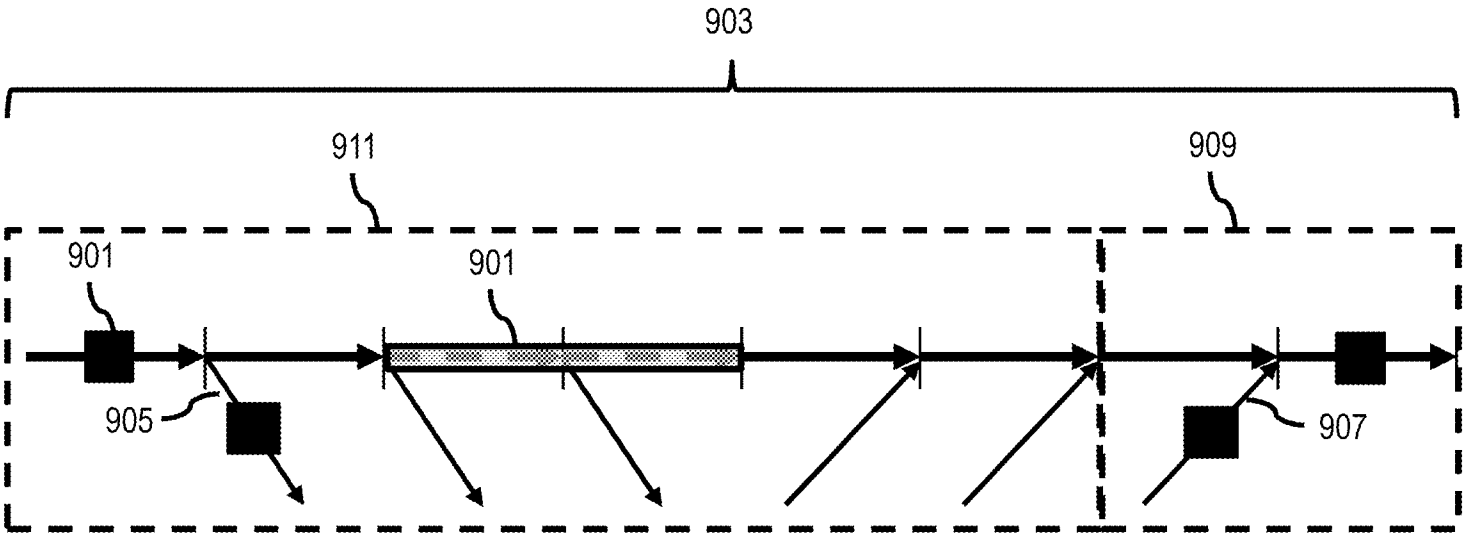
FIG. 9 is a diagram of an example road network that does not include a vehicle re-entering a highway, according to one embodiment.

However, even with an expanded closure link graph, there can be cases that the road graph is not large enough to capture a vehicle re-entering the highway. This case is illustrated in FIG. 9. As shown, a vehicle 901 (represented by a solid square) is seen on the highway 903 and exits the highway 903 at exit ramp 905. Even though the vehicle 901 re-enters the highway 903 later at entry ramp 907, this is not captured because the entry ramp 907 is in a downstream area 909 that is not included in the closure link graph 911; hence, the feature module 205 does not receive this input. However, in one embodiment, the feature module 205 has enough information in the closure link graph 911 to deduce that vehicle 901 has exited, and therefore vehicle 901 is counted as part of the detouring feature.

Figure 10:
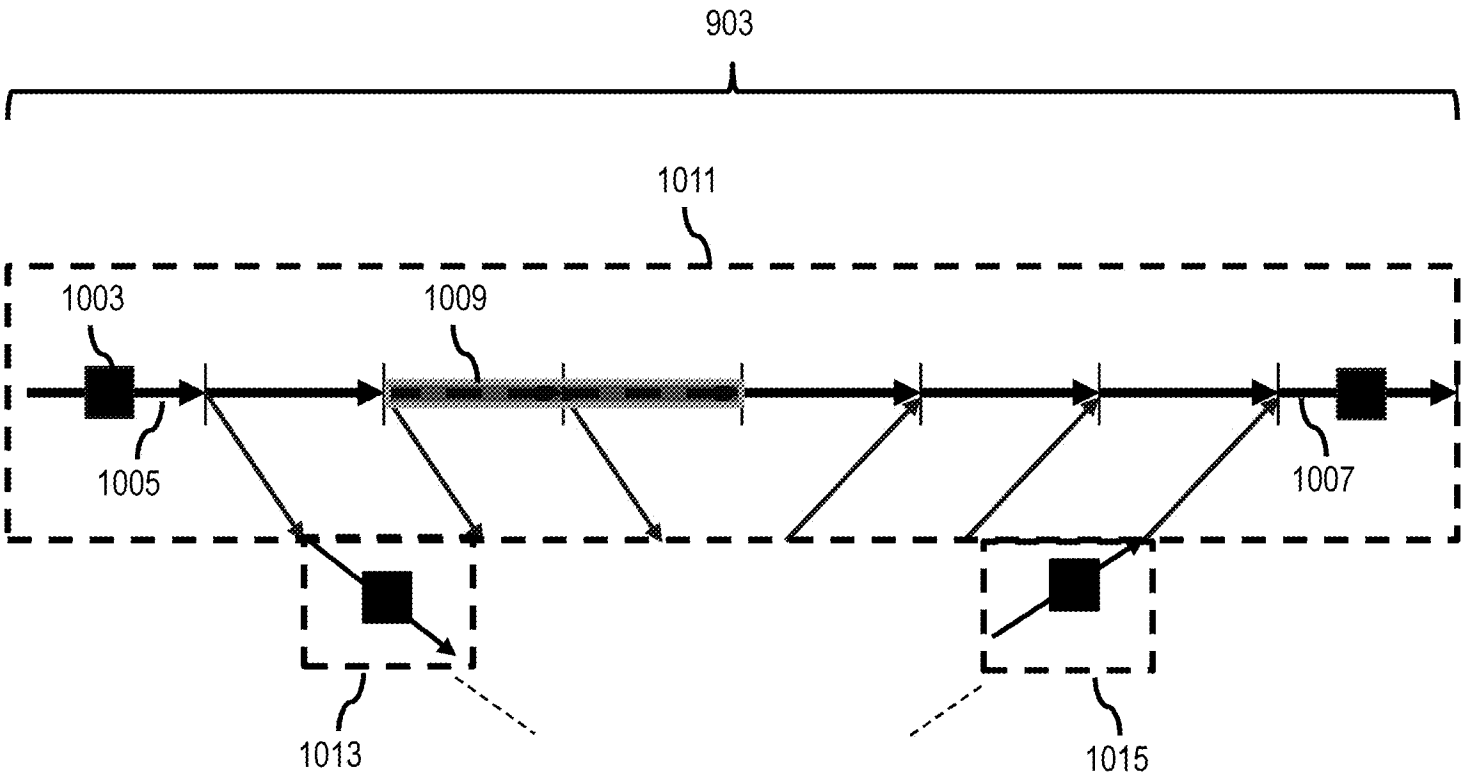
FIG. 10 is a diagram of an example road network that does not capture exit or re-entry of a vehicle, according to one embodiment.

As shown in FIG. 10, another scenario is where road network of the closure link graph 1001 captures probes for the vehicle 1003 before (e.g., on upstream link 1005) and after (e.g., on downstream link 1007) the evaluated link/superlink 1009. In this case, there are two possibilities:

1. The vehicle 1003 has not left the highway 1001 between upstream link 1005 and downstream link 1007.
2. The vehicle 1003 has left and re-entered the highway 1001 between upstream link 1005 and downstream link 1007. However, the road network of the closure link graph 1011 did not capture exiting and re-entry because they occurred respective on links 1013 and 1015 that were not included in the closure link graph 1011, and hence were not monitored.

In one embodiment, the feature module 205 can decide algorithmically which scenario has more likely happened according to the process below or equivalent:

1. A vehicle reports probes with a given frequency. By looking at the vehicle's previous probes, calculate the reporting frequency.
2. Compare this frequency against the time difference between the probes before and after the evaluated links.
   2.1 If time_delta>reporting_frequency*k, the feature module 205 can classify the vehicle as having detoured around the evaluated links/superlinks. Therefore, the feature module 205 can increment the detouring vehicles feature (e.g., by 1).
   2.2 Else, the feature module 205 can classify the vehicle as having driven through the evaluated link/superlinks and does not increment the detouring vehicles feature.

Figure 11:
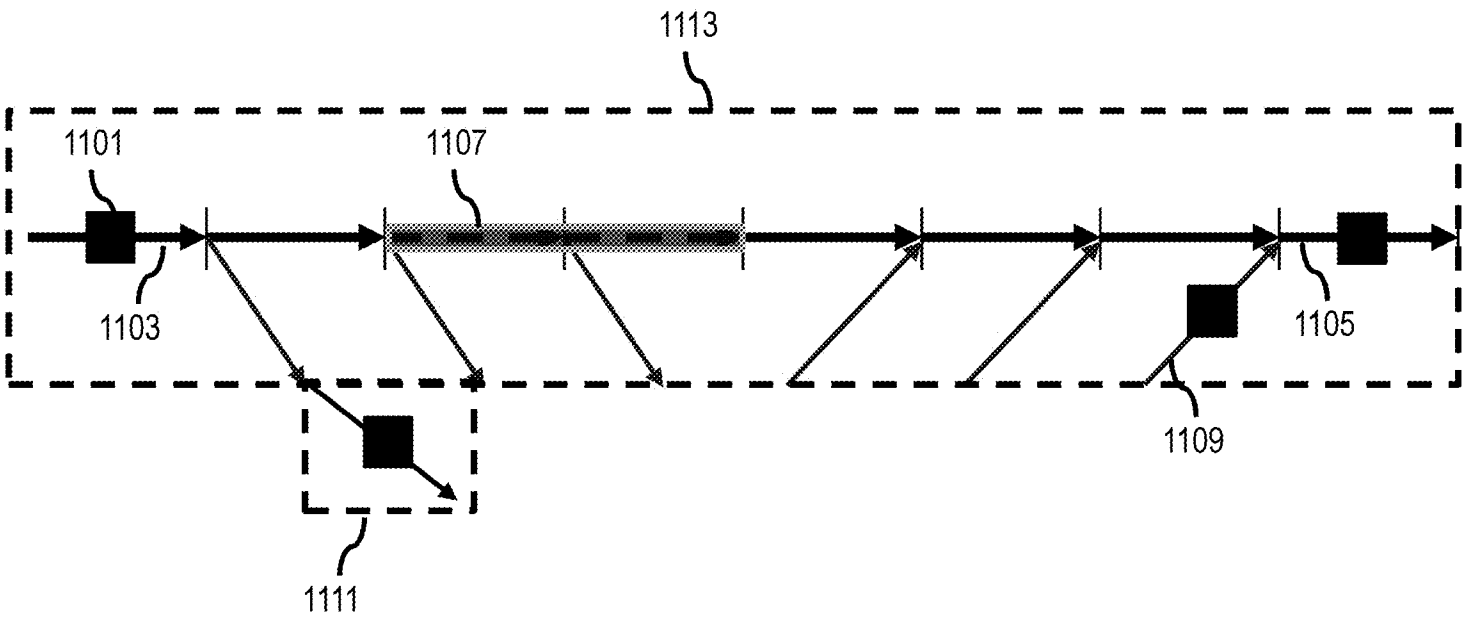
FIG. 11 is a diagram of an example road network that does not capture exit of a vehicle, according to one embodiment.
Figure 12:
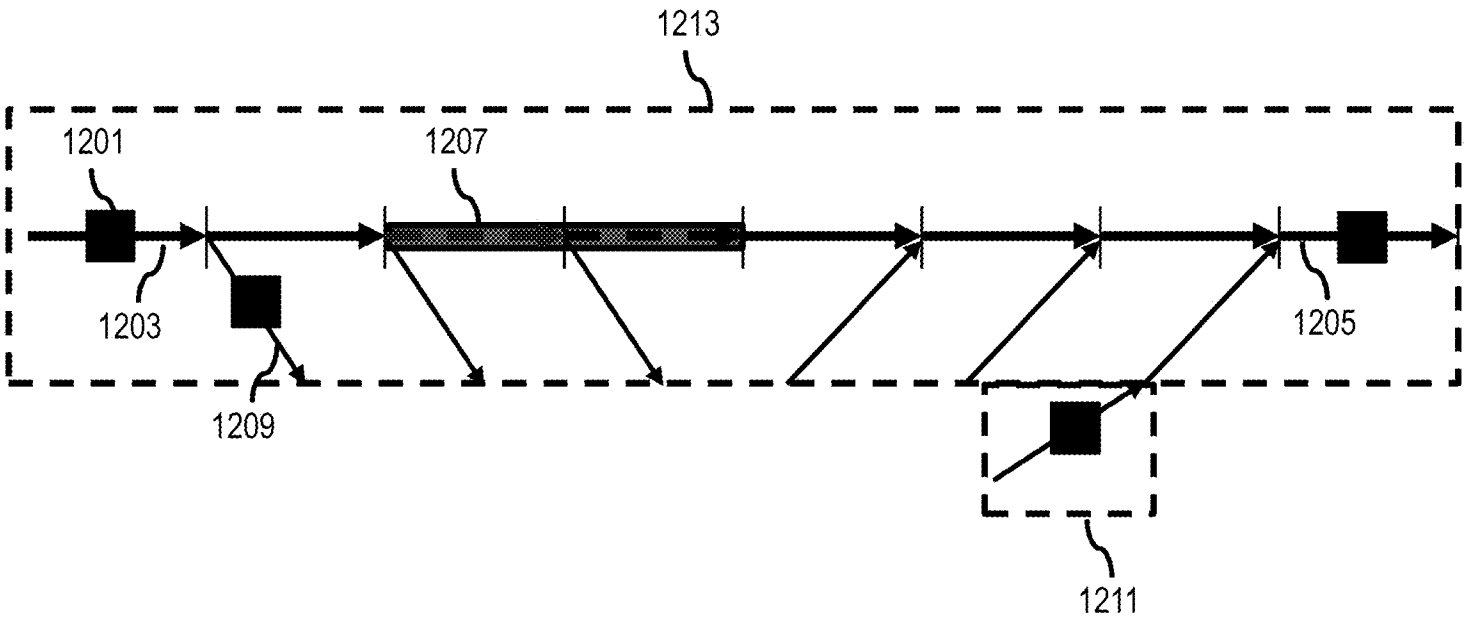
FIG. 12 is a diagram of an example road network that does not capture re-entry of a vehicle, according to one embodiment.

FIGS. 11 and 12 illustrate similar scenarios where the road network of the closure link graph does not capture either the exiting or re-entering probes. For example, FIG. 11 illustrates the scenario where probes of the vehicle 1101 are present on the upstream link 1103 and downstream link 1105 of the evaluated link/superlink 1107, but only the probe on the reentry ramp 1109 is captured because the exit link 1111 was not included in the closure link graph 1113 being monitored. However, the feature module 205 can still classify the vehicle as a detouring vehicle based on the probe on the reentry ramp 1109, and then increment the detouring vehicles feature accordingly.

In the scenario of FIG. 12, probes of the vehicle 1201 are present on the upstream link 1203 and downstream link 1205 of the evaluate link/superlink 1207, but only the probe on the exit ramp 1209 is captured because the reentry link 1211 was not included in the closure link graph 1213 being monitored. As in the case above, the feature module 205 can still classify the vehicle as a detouring vehicle based on the probe on the exit ramp 1209, and then increment the detouring vehicles feature accordingly.

In one embodiment, another set of important features are based on vehicle speeds. For example, non-zero values for through vehicles feature are an indication of vehicle presence on the road. Yet these vehicles can be construction vehicles doing work on a closed road or emergency vehicles operating at an accident site which is closed to traffic. Therefore, under some scenarios, the through vehicles feature can be misleading on its own. To address this issue, the feature module 205 can calculate a vehicle speed feature (e.g., representing speeds of the probes in the closure link graph). For example, construction vehicles or emergency vehicles operating at a closure site usually have either zero speed values or close to zero speed values. In on embodiment, the feature module 205 can use the vehicle speed feature to:

- remove the vehicles from the through vehicles feature (in case of close-to-zero speeds);
- mark these vehicles as construction/emergency vehicles (in case of close-to-zero speeds); and/or
- open the road in case of high speeds.

It is contemplated that the vehicle speed feature can be any characteristic, attribute, property, etc. that is indicative of the speed of a vehicles traveling in the road network of the closure link graph including but not limited to:

- mean vehicle speed;
- median vehicle speed (in case of an outlier vehicle with a very high or miscalculated speed; and/or
- number/percent of vehicles with less than a small speed threshold. An example could be: there are 5 vehicles with speeds 2 kph, 3 kph, 5 kph, 20 kph and 50 kph. Small speed threshold is 10 kph. Then the feature would be 3/5=60%.

In one embodiment, another feature can be a Closure Report Source Confidence. Incident sources which report closures do not necessarily have the same quality. Some of them are very accurate, whereas others are less. The feature module 205 can take advantage of this information. For example, based on previous performance, incident sources can be assigned a confidence value; the higher the confidence value, the more trusted a source is. In one embodiment, this information could then be used for ambiguous cases; e.g., in the middle of the night a reported superlink which expects to see 1.5 vehicles on average has only one vehicle going through it. In other words, source confidence could be used to decide whether to trust the source or to discard it when verifying road closures.

In one embodiment, temporal features can also be considered. Generally, all of the features described above are calculated for the current epoch (e.g., over probes received in the past 5 minutes). However, acting on information received only in the current epoch can be prone for errors. For example, if the epoch is short (e.g., 5 minutes), then algorithm decisions will be to reactive to noise: the algorithm will act on any small change that affects the dynamics of the road network for a few minutes. On the other hand, if the epoch is too long (e.g., 1 hour), the algorithm will not react fast to a closure. In one embodiment, to overcome this dilemma, the feature module 205 can calculate the above-mentioned features for a small epoch (e.g., epoch below a time duration threshold such as 5 minutes) as well as for a long epoch (e.g., epoch above a time duration threshold such as 1 hour). The features determined for both the short and long epochs can then be used alone or in combination to make a decision on a superlink's closure status.

In yet another embodiment, the feature module 205 can also calculate and consider spatial features. While each superlink is evaluated individually, the closure status of a link/superlink carries valuable information on the status of its neighbors. For instance, considering five consecutive links/superlinks, if links/superlinks 1, 2, 4 and 5 are closed, there is a good chance the link/superlink in the middle, i.e., superlink 3, is also closed. Therefore, the feature module 205 can use the spatial relationship between a road link, its upstream and/or downstream links, and their respective known closure status information to infer the status for links/superlinks with closure status that is being verified or determined.

After calculating the features derived from probe data of closure link graph being monitored or evaluated, the closure verification module 207 can evaluate the closure probability of the road link indicated by the road closure report based on the calculated features (step 309). The closure probability, in turn, can then be used to automatically verify a road closure or road closure report. In other words, once the features are generated according to the various embodiments described above, each link/superlink is evaluated individually to determine whether it is closed, open, partially opened, or otherwise affected by a traffic incident. In one embodiment, this evaluation can follow a rule-based algorithm, a machine-learning based algorithm, or any equivalent process known in the art.

For example, a rule-based algorithm can combine one or more of the features as a set of logical sentences with evaluation criteria (e.g., feature1>3 and feature2<2|feature 3==1.5 and feature 4 is false). A machine-learning based algorithm, for instance, can use labeled training data, which for each link/superlink-epoch pair closure state is known or labeled (e.g., state is closed or open). The algorithm then selects a learner (e.g., neural network, support vector machine etc.), and adjusts weights of the features to minimize the loss function given the labels. In the final step, the machine-learning process produces a closure probability for a given superlink based on the trained model. If this probability is beyond a certain threshold, the machine learning classifier can classify the link/superlink as closed; otherwise, the link/superlink can be classified as open. For example, this decision or classification threshold could be 0.5, where a probability above 0.5 would indicate closure and a value below 0.5 would indicate the superlink is open.

In one embodiment, the closure verification module 207 can perform decision hysteresis avoidance. When the features have ambiguous values, the closure verification module 207 might produce a closure probability close to the decision threshold. Accordingly, with slight changes to any of the feature values, the closure probability could go beyond the threshold, come back and exceed the threshold again multiple times in a short time interval. This would result in multiple back-and-forths between different closures states (e.g., open and closed states). In one embodiment, to avoid such fluctuations around the decision threshold by using multiple asymmetric decision thresholds.

The following pseudo code describes, for instance, how this problem is solved using two more thresholds on top of decision threshold. In this example, these thresholds are Closure Threshold and Opening Threshold.

1. For the first time, when the closure verification module 207 is going to make a closure verification decision, it calculates a closure probability and decides on a closure status by comparing this closure probability to decision threshold. If probability>=decision threshold, close the road. Else open it.
2. In subsequent decisions, again the closure probability is calculated. However, this time it is compared against one of the new thresholds depending on the most recent closure state. By doing this, the decision threshold is ignored. Specifically,
   a. If the most recent closure state=closed, compare closure probability to Opening Threshold. If closure probability<Opening Threshold, open the road. Else, keep the state as closed. In one embodiment, the Opening Threshold differs from the original decision threshold by a predetermined value. This predetermined value can be based on the desired sensitivity to noise or fluctuations (e.g., greater differences between the Opening Threshold and the original decision threshold reduce fluctuations between closure states, while smaller differences between the Opening Threshold and the original decision threshold are more susceptible to fluctuations between closure states).
   b. If the most recent closure state=open, compare closure probability to Closure Threshold. If closure probability>Closure Threshold, close the road. Else keep the state as open. The Closure Threshold can be set analogously as described with respect to the Opening Threshold described above.

Examples of the thresholds are as follows:
   Decision Threshold=0.5
   Opening Threshold=0.25
   Closure Threshold=0.75

The following example illustrates hysteresis avoidance using the example thresholds listed above:

@time=t1: Initial closure probability=0.52: Road status is set to closed.

@time=t2: Closure probability=0.35: Road status remains closed as closure probability is greater than Opening Threshold.

@time=t3: Closure probability=0.22: Road status set to open as closure probability is less than Opening Threshold.

@time=t4: Closure Probability=0.67: Road status remains open as closure probability is less than Closure Threshold.

@time=t5: Closure Probability=0.80: Road status set to closed as closure probability is greater than Closure Threshold.

Returning to FIG. 1, in one embodiment, the mapping platform 111 has connectivity over a communication network 117 to other components of the system 100 including but not limited to road closure reports 101, services platform 103, services 105, content providers 107, geographic database 109, and/or vehicles 113 (e.g., probes). By way of example, the services 105 may also be other third-party services and include traffic incident services (e.g., to report road closures), mapping services, navigation services, travel planning services, notification services, social networking services, content (e.g., audio, video, images, etc.) provisioning services, application services, storage services, contextual information determination services, location-based services, information-based services (e.g., weather, news, etc.), etc. In one embodiment, the services platform 103 uses the output (e.g. physical divider predictions) of the mapping platform 111 to provide services such as navigation, mapping, other location-based services, etc.

In one embodiment, the mapping platform 111 may be a platform with multiple interconnected components. The mapping platform 111 may include multiple servers, intelligent networking devices, computing devices, components and corresponding software for providing parametric representations of lane lines. In addition, it is noted that the mapping platform 111 may be a separate entity of the system 100, a part of the one or more services 105, a part of the services platform 103, or included within the vehicle 113.

In one embodiment, content providers 107*a*-107*m* (collectively referred to as content providers 107) may provide content or data (e.g., including geographic data, parametric representations of mapped features, etc.) to the geographic database 109, the mapping platform 111, the services platform 103, the services 105, and the vehicle 113. The content provided may be any type of content, such as traffic incident content (e.g., road closure reports), map content, textual content, audio content, video content, image content, etc. In one embodiment, the content providers 107 may provide content that may aid in the detecting and classifying of road closures or other traffic incidents. In one embodiment, the content providers 107 may also store content associated with the geographic database 109, mapping platform 111, services platform 103, services 105, and/or vehicle 113. In another embodiment, the content providers 107 may manage access to a central repository of data, and offer a consistent, standard interface to data, such as a repository of the geographic database 109.

In one embodiment, the vehicles 113, for instance, are part of a probe-based system for collecting probe data for detecting traffic incidents and/or measuring traffic conditions in a road network. In one embodiment, each vehicle 113 is configured to report probe data as probe points, which are individual data records collected at a point in time that records telemetry data for that point in time. In one embodiment, the probe ID can be permanent or valid for a certain period of time. In one embodiment, the probe ID is cycled, particularly for consumer-sourced data, to protect the privacy of the source.

In one embodiment, a probe point can include attributes such as: (1) probe ID, (2) longitude, (3) latitude, (4) heading, (5) speed, and (6) time. The list of attributes is provided by way of illustration and not limitation. Accordingly, it is contemplated that any combination of these attributes or other attributes may be recorded as a probe point. For example, attributes such as altitude (e.g., for flight capable vehicles or for tracking non-flight vehicles in the altitude domain), tilt, steering angle, wiper activation, etc. can be included and reported for a probe point. In one embodiment, the vehicles 113 may include sensors 115 for reporting measuring and/or reporting attributes. The attributes can also be any attribute normally collected by an on-board diagnostic (OBD) system of the vehicle, and available through an interface to the OBD system (e.g., OBD II interface or other similar interface). In one embodiment, this data allows the system 100 to calculate or construct vehicle paths of a vehicle 113 over a stretch of road (e.g., over a closure link graph).

The probe points can be reported from the vehicles 113 in real-time, in batches, continuously, or at any other frequency requested by the system 100 over, for instance, the communication network 117 for processing by the mapping platform 111. The probe points also can be mapped to specific road links stored in the geographic database 109. In one embodiment, the system 100 (e.g., via the token platform 107) can generate probe traces (e.g., vehicle paths or trajectories) from the probe points for an individual probe so that the probe traces represent a travel trajectory or vehicle path of the probe through the road network.

In one embodiment, the vehicle 113 is configured with various sensors 115 for generating or collecting vehicular sensor data, related geographic/map data, etc. In one embodiment, the sensed data represent sensor data associated with a geographic location or coordinates at which the sensor data was collected. In this way, the sensor data can act as observation data that can be separated into location-aware training and evaluation datasets according to their data collection locations as well as used for evaluating road closure reports according to the embodiments described herein. By way of example, the sensors may include a radar system, a LiDAR system, a global positioning sensor for gathering location data (e.g., GPS), a network detection sensor for detecting wireless signals or receivers for different short-range communications (e.g., Bluetooth, Wi-Fi, Li-Fi, near field communication (NFC) etc.), temporal information sensors, a camera/imaging sensor for gathering image data, an audio recorder for gathering audio data, velocity sensors mounted on steering wheels of the vehicles, switch sensors for determining whether one or more vehicle switches are engaged, and the like.

Other examples of sensors of the vehicle 113 may include light sensors, orientation sensors augmented with height sensors and acceleration sensor (e.g., an accelerometer can measure acceleration and can be used to determine orientation of the vehicle), tilt sensors to detect the degree of incline or decline of the vehicle along a path of travel, moisture sensors, pressure sensors, etc. In a further example embodiment, sensors about the perimeter of the vehicle 113 may detect the relative distance of the vehicle from a physical divider, a lane or roadway, the presence of other vehicles, pedestrians, traffic lights, potholes and any other objects, or a combination thereof. In one scenario, the sensors may detect weather data, traffic information, or a combination thereof. In one embodiment, the vehicle 113 may include GPS or other satellite-based receivers to obtain geographic coordinates from satellites for determining current location and time. Further, the location can be determined by visual odometry, triangulation systems such as A-GPS, Cell of Origin, or other location extrapolation technologies. In yet another embodiment, the sensors can determine the status of various control elements of the car, such as activation of wipers, use of a brake pedal, use of an acceleration pedal, angle of the steering wheel, activation of hazard lights, activation of head lights, etc.

In one embodiment, the communication network 117 of system 100 includes one or more networks such as a data network, a wireless network, a telephony network, or any combination thereof. It is contemplated that the data network may be any local area network (LAN), metropolitan area network (MAN), wide area network (WAN), a public data network (e.g., the Internet), short range wireless network, or any other suitable packet-switched network, such as a commercially owned, proprietary packet-switched network, e.g., a proprietary cable or fiber-optic network, and the like, or any combination thereof. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UNITS), etc., as well as any other suitable wireless medium, e.g., worldwide interoperability for microwave access (WiMAX), Long Term Evolution (LTE) networks, code division multiple access (CDMA), wideband code division multiple access (WCDMA), wireless fidelity (Wi-Fi), wireless LAN (WLAN), Bluetooth®, Internet Protocol (IP) data casting, satellite, mobile ad-hoc network (MANET), and the like, or any combination thereof.

By way of example, the mapping platform 111, services platform 103, services 105, vehicle 113, and/or content providers 107 communicate with each other and other components of the system 100 using well known, new or still developing protocols. In this context, a protocol includes a set of rules defining how the network nodes within the communication network 117 interact with each other based on information sent over the communication links. The protocols are effective at different layers of operation within each node, from generating and receiving physical signals of various types, to selecting a link for transferring those signals, to the format of information indicated by those signals, to identifying which software application executing on a computer system sends or receives the information. The conceptually different layers of protocols for exchanging information over a network are described in the Open Systems Interconnection (OSI) Reference Model.

Communications between the network nodes are typically effected by exchanging discrete packets of data. Each packet typically comprises (1) header information associated with a particular protocol, and (2) payload information that follows the header information and contains information that may be processed independently of that particular protocol. In some protocols, the packet includes (3) trailer information following the payload and indicating the end of the payload information. The header includes information such as the source of the packet, its destination, the length of the payload, and other properties used by the protocol. Often, the data in the payload for the particular protocol includes a header and payload for a different protocol associated with a different, higher layer of the OSI Reference Model. The header for a particular protocol typically indicates a type for the next protocol contained in its payload. The higher layer protocol is said to be encapsulated in the lower layer protocol. The headers included in a packet traversing multiple heterogeneous networks, such as the Internet, typically include a physical (layer 1) header, a data-link (layer 2) header, an internetwork (layer 3) header and a transport (layer 4) header, and various application (layer 5, layer 6 and layer 7) headers as defined by the OSI Reference Model.

Figure 13:
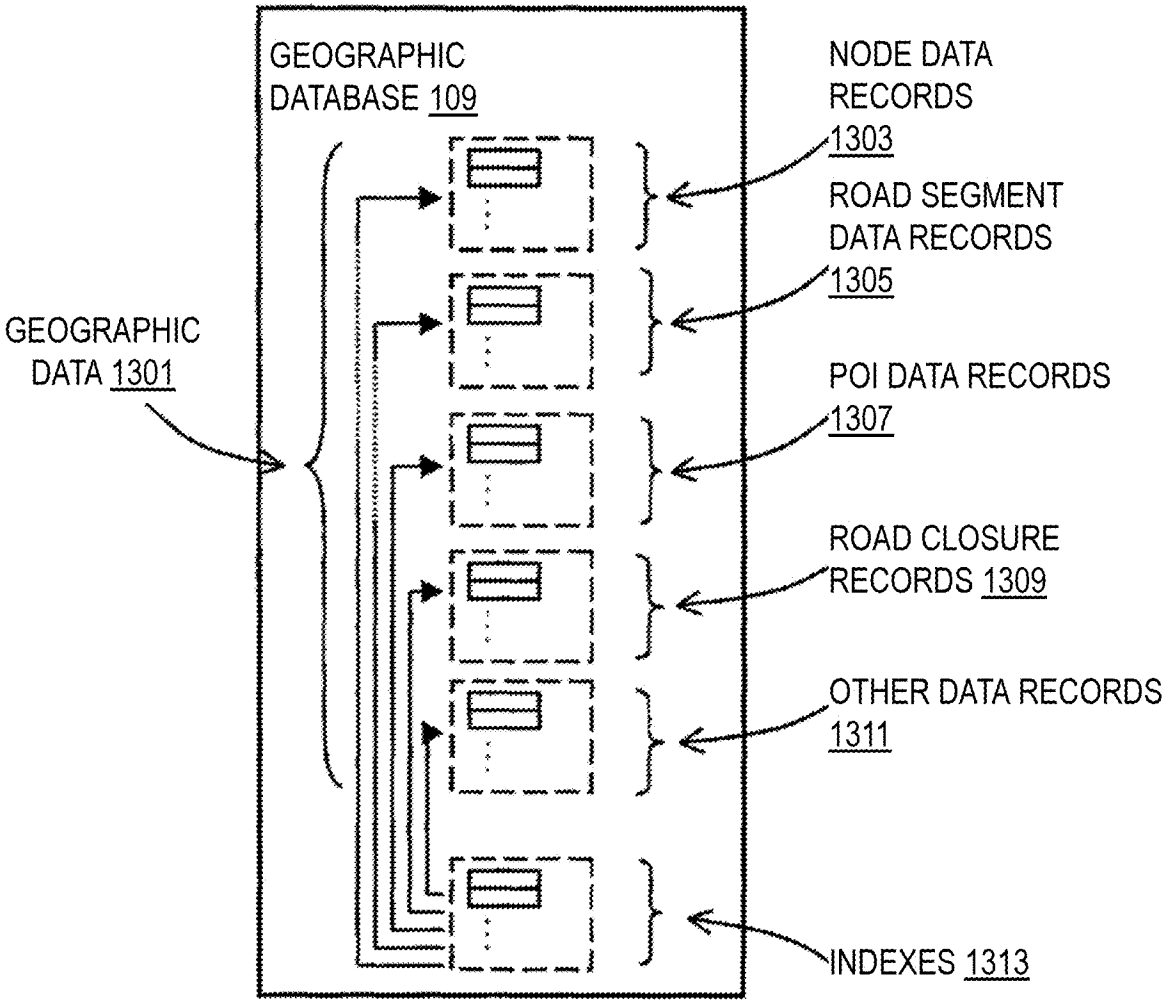
FIG. 13 is a diagram of a geographic database, according to one embodiment.

FIG. 13 is a diagram of a geographic database, according to one embodiment. In one embodiment, the geographic database 109 includes geographic data 1301 used for (or configured to be compiled to be used for) mapping and/or navigation-related services. In one embodiment, geographic features (e.g., two-dimensional or three-dimensional features) are represented using polygons (e.g., two-dimensional features) or polygon extrusions (e.g., three-dimensional features). For example, the edges of the polygons correspond to the boundaries or edges of the respective geographic feature. In the case of a building, a two-dimensional polygon can be used to represent a footprint of the building, and a three-dimensional polygon extrusion can be used to represent the three-dimensional surfaces of the building. It is contemplated that although various embodiments are discussed with respect to two-dimensional polygons, it is contemplated that the embodiments are also applicable to three-dimensional polygon extrusions. Accordingly, the terms polygons and polygon extrusions as used herein can be used interchangeably.

In one embodiment, the following terminology applies to the representation of geographic features in the geographic database 109.

"Node"—A point that terminates a link.

"Line segment"—A straight line connecting two points.

"Link" (or "edge")—A contiguous, non-branching string of one or more line segments terminating in a node at each end.

"Shape point"—A point along a link between two nodes (e.g., used to alter a shape of the link without defining new nodes).

"Oriented link"—A link that has a starting node (referred to as the "reference node") and an ending node (referred to as the "non reference node").

"Simple polygon"—An interior area of an outer boundary formed by a string of oriented links that begins and ends in one node. In one embodiment, a simple polygon does not cross itself.

"Polygon"—An area bounded by an outer boundary and none or at least one interior boundary (e.g., a hole or island). In one embodiment, a polygon is constructed from one outer simple polygon and none or at least one inner simple polygon. A polygon is simple if it just consists of one simple polygon, or complex if it has at least one inner simple polygon.

In one embodiment, the geographic database 109 follows certain conventions. For example, links do not cross themselves and do not cross each other except at a node. Also, there are no duplicated shape points, nodes, or links. Two links that connect each other have a common node. In the geographic database 109, overlapping geographic features are represented by overlapping polygons. When polygons overlap, the boundary of one polygon crosses the boundary of the other polygon. In the geographic database 109, the location at which the boundary of one polygon intersects they boundary of another polygon is represented by a node. In one embodiment, a node may be used to represent other locations along the boundary of a polygon than a location at which the boundary of the polygon intersects the boundary of another polygon. In one embodiment, a shape point is not used to represent a point at which the boundary of a polygon intersects the boundary of another polygon.

As shown, the geographic database 109 includes node data records 1303, road segment or link data records 1305, POI data records 1307, road closure data records 1309, other records 1311, and indexes 1313, for example. More, fewer or different data records can be provided. In one embodiment, additional data records (not shown) can include cartographic ("carto") data records, routing data, and maneuver data. In one embodiment, the indexes 1313 may improve the speed of data retrieval operations in the geographic database 109. In one embodiment, the indexes 1313 may be used to quickly locate data without having to search every row in the geographic database 109 every time it is accessed. For example, in one embodiment, the indexes 1313 can be a spatial index of the polygon points associated with stored feature polygons.

In exemplary embodiments, the road segment data records 1305 are links or segments representing roads, streets, or paths, as can be used in the calculated route or recorded route information for determination of one or more personalized routes. The node data records 1303 are end points corresponding to the respective links or segments of the road segment data records 1305. The road link data records 1305 and the node data records 1303 represent a road network, such as used by vehicles, cars, and/or other entities. Alternatively, the geographic database 109 can contain path segment and node data records or other data that represent pedestrian paths or areas in addition to or instead of the vehicle road record data, for example.

The road/link segments and nodes can be associated with attributes, such as geographic coordinates, street names, address ranges, speed limits, turn restrictions at intersections, and other navigation related attributes, as well as POIs, such as gasoline stations, hotels, restaurants, museums, stadiums, offices, automobile dealerships, auto repair shops, buildings, stores, parks, etc. The geographic database 109 can include data about the POIs and their respective locations in the POI data records 1307. The geographic database 109 can also include data about places, such as cities, towns, or other communities, and other geographic features, such as bodies of water, mountain ranges, etc. Such place or feature data can be part of the POI data records 1307 or can be associated with POIs or POI data records 1307 (such as a data point used for displaying or representing a position of a city).

In one embodiment, the geographic database 109 includes the road closure data records 1309 for storing predicted road closure reports, road closure evaluations, road closure link graphs, associated probe data/vehicle paths, extracted features derived from the probe data, and/or any other related data. The road closure data records 1309 comprise of the road closure data layer 119 that store the automatically generated road closure classifications generated according to the various embodiments described herein. The road closure data layer 119 can be provided to other system components or end users to provided related mapping, navigation, and/or other location-based services. In one embodiment, the road closure data records 1309 can be associated with segments of a road link (as opposed to an entire link). It is noted that the segmentation of the road for the purposes of physical divider prediction can be different than the road link structure of the geographic database 109. In other words, the segments can further subdivide the links of the geographic database 109 into smaller segments (e.g., of uniform lengths such as 5-meters). In this way, road closures or other traffic incidents can be predicted and represented at a level of granularity that is independent of the granularity or at which the actual road or road network is represented in the geographic database 109. In one embodiment, the road closure data records 1309 can be associated with one or more of the node records 1303, road segment or link records 1305, and/or POI data records 1307; or portions thereof (e.g., smaller or different segments than indicated in the road segment records 1305) to provide situational awareness to drivers and provide for safer autonomous operation of vehicles.

In one embodiment, the geographic database 109 can be maintained by the content provider 107 in association with the services platform 103 (e.g., a map developer). The map developer can collect geographic data to generate and enhance the geographic database 109. There can be different ways used by the map developer to collect data. These ways can include obtaining data from other sources, such as municipalities or respective geographic authorities. In addition, the map developer can employ field personnel to travel by vehicle along roads throughout the geographic region to observe features (e.g., road closures or other traffic incidents, etc.) and/or record information about them, for example. Also, remote sensing, such as aerial or satellite photography, can be used.

In one embodiment, the geographic database 109 include high resolution or high definition (HD) mapping data that provide centimeter-level or better accuracy of map features. For example, the geographic database 109 can be based on Light Detection and Ranging (LiDAR) or equivalent technology to collect billions of 3D points and model road surfaces and other map features down to the number lanes and their widths. In one embodiment, the HD mapping data capture and store details such as the slope and curvature of the road, lane markings, roadside objects such as sign posts, including what the signage denotes. By way of example, the HD mapping data enable highly automated vehicles to precisely localize themselves on the road, and to determine road attributes (e.g., learned speed limit values) to at high accuracy levels.

In one embodiment, the geographic database 109 is stored as a hierarchical or multilevel tile-based projection or structure. More specifically, in one embodiment, the geographic database 109 may be defined according to a normalized Mercator projection. Other projections may be used. By way of example, the map tile grid of a Mercator or similar projection is a multilevel grid. Each cell or tile in a level of the map tile grid is divisible into the same number of tiles of that same level of grid. In other words, the initial level of the map tile grid (e.g., a level at the lowest zoom level) is divisible into four cells or rectangles. Each of those cells are in turn divisible into four cells, and so on until the highest zoom or resolution level of the projection is reached.

In one embodiment, the map tile grid may be numbered in a systematic fashion to define a tile identifier (tile ID). For example, the top left tile may be numbered 00, the top right tile may be numbered 01, the bottom left tile may be numbered 10, and the bottom right tile may be numbered 11. In one embodiment, each cell is divided into four rectangles and numbered by concatenating the parent tile ID and the new tile position. A variety of numbering schemes also is possible. Any number of levels with increasingly smaller geographic areas may represent the map tile grid. Any level (n) of the map tile grid has 2(n+1) cells. Accordingly, any tile of the level (n) has a geographic area of A/2(n+1) where A is the total geographic area of the world or the total area of the map tile grid 10. Because of the numbering system, the exact position of any tile in any level of the map tile grid or projection may be uniquely determined from the tile ID.

In one embodiment, the system 100 may identify a tile by a quadkey determined based on the tile ID of a tile of the map tile grid. The quadkey, for example, is a one-dimensional array including numerical values. In one embodiment, the quadkey may be calculated or determined by interleaving the bits of the row and column coordinates of a tile in the grid at a specific level. The interleaved bits may be converted to a predetermined base number (e.g., base 10, base 4, hexadecimal). In one example, leading zeroes are inserted or retained regardless of the level of the map tile grid in order to maintain a constant length for the one-dimensional array of the quadkey. In another example, the length of the one-dimensional array of the quadkey may indicate the corresponding level within the map tile grid 10. In one embodiment, the quadkey is an example of the hash or encoding scheme of the respective geographical coordinates of a geographical data point that can be used to identify a tile in which the geographical data point is located.

The geographic database 109 can be a master geographic database stored in a format that facilitates updating, maintenance, and development. For example, the master geographic database or data in the master geographic database can be in an Oracle spatial format or other spatial format, such as for development or production purposes. The Oracle spatial format or development/production database can be compiled into a delivery format, such as a geographic data files (GDF) format. The data in the production and/or delivery formats can be compiled or further compiled to form geographic database products or databases, which can be used in end user navigation devices or systems.

For example, geographic data is compiled (such as into a platform specification format (PSF) format) to organize and/or configure the data for performing navigation-related functions and/or services, such as route calculation, route guidance, map display, speed calculation, distance and travel time functions, and other functions, by a navigation device, such as by the vehicle 113, for example. The navigation-related functions can correspond to vehicle navigation, pedestrian navigation, or other types of navigation. The compilation to produce the end user databases can be performed by a party or entity separate from the map developer. For example, a customer of the map developer, such as a navigation device developer or other end user device developer, can perform compilation on a received geographic database in a delivery format to produce one or more compiled navigation databases.

The processes described herein for automatically verifying road closure reports may be advantageously implemented via software, hardware (e.g., general processor, Digital Signal Processing (DSP) chip, an Application Specific Integrated Circuit (ASIC), Field Programmable Gate Arrays (FPGAs), etc.), firmware or a combination thereof. Such exemplary hardware for performing the described functions is detailed below.

Figure 14:
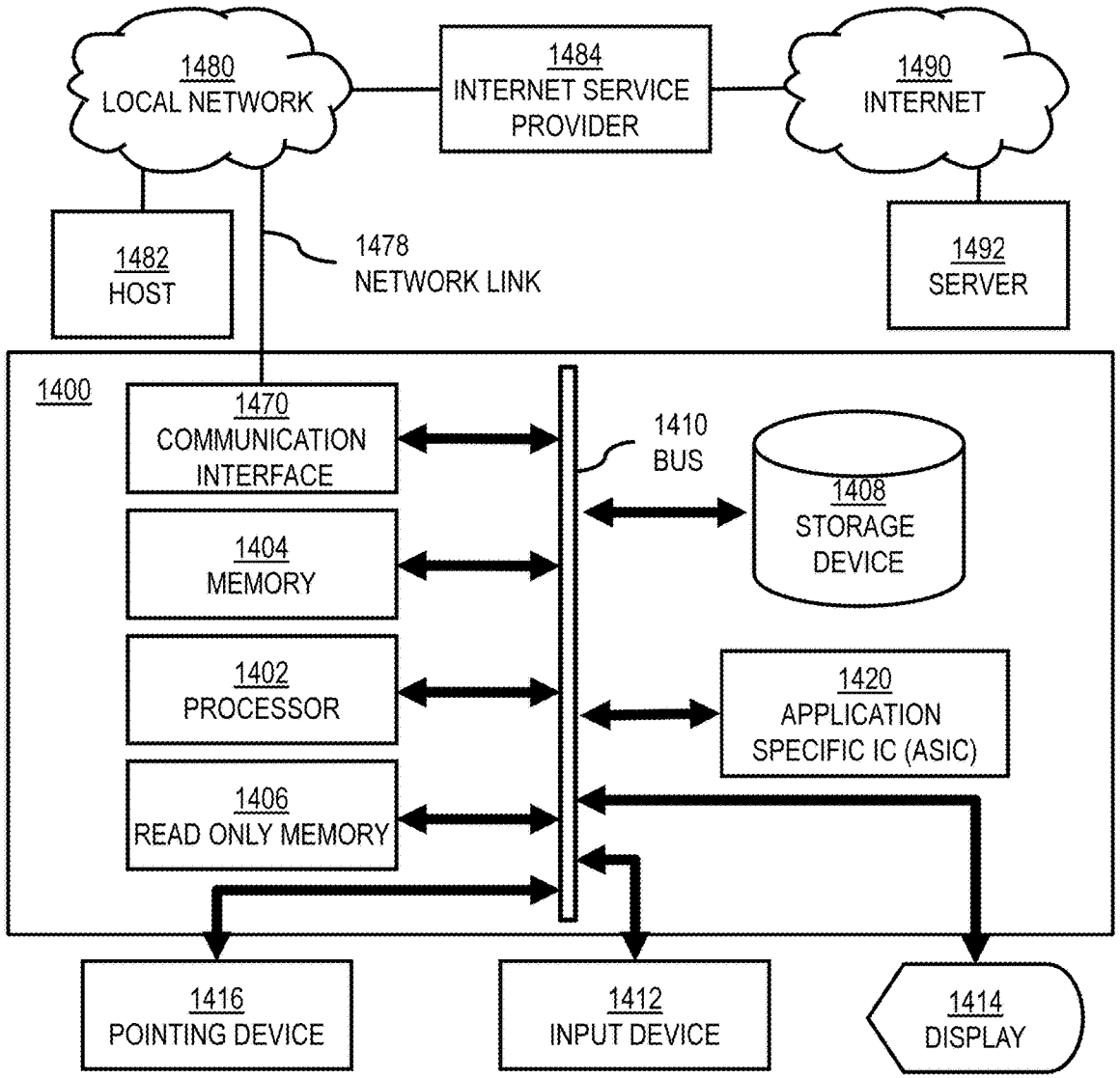
FIG. 14 is a diagram of hardware that can be used to implement an embodiment.

FIG. 14 illustrates a computer system 1400 upon which an embodiment of the invention may be implemented. Computer system 1400 is programmed (e.g., via computer program code or instructions) to automatically verify road closure reports as described herein and includes a communication mechanism such as a bus 1410 for passing information between other internal and external components of the computer system 1400. Information (also called data) is represented as a physical expression of a measurable phenomenon, typically electric voltages, but including, in other embodiments, such phenomena as magnetic, electromagnetic, pressure, chemical, biological, molecular, atomic, sub-atomic and quantum interactions. For example, north and south magnetic fields, or a zero and non-zero electric voltage, represent two states (0, 1) of a binary digit (bit). Other phenomena can represent digits of a higher base. A superposition of multiple simultaneous quantum states before measurement represents a quantum bit (qubit). A sequence of one or more digits constitutes digital data that is used to represent a number or code for a character. In some embodiments, information called analog data is represented by a near continuum of measurable values within a particular range.

A bus 1410 includes one or more parallel conductors of information so that information is transferred quickly among devices coupled to the bus 1410. One or more processors 1402 for processing information are coupled with the bus 1410.

A processor 1402 performs a set of operations on information as specified by computer program code related to automatically verifying road closure reports. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 1410 and placing information on the bus 1410. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 1402, such as a sequence of operation codes, constitute processor instructions, also called computer system instructions or, simply, computer instructions. Processors may be implemented as mechanical, electrical, magnetic, optical, chemical or quantum components, among others, alone or in combination.

Computer system 1400 also includes a memory 1404 coupled to bus 1410. The memory 1404, such as a random access memory (RANI) or other dynamic storage device, stores information including processor instructions for automatically verifying road closure reports. Dynamic memory allows information stored therein to be changed by the computer system 1400. RAM allows a unit of information stored at a location called a memory address to be stored and retrieved independently of information at neighboring addresses. The memory 1404 is also used by the processor 1402 to store temporary values during execution of processor instructions. The computer system 1400 also includes a read only memory (ROM) 1406 or other static storage device coupled to the bus 1410 for storing static information, including instructions, that is not changed by the computer system 1400. Some memory is composed of volatile storage that loses the information stored thereon when power is lost. Also coupled to bus 1410 is a non-volatile (persistent) storage device 1408, such as a magnetic disk, optical disk or flash card, for storing information, including instructions, that persists even when the computer system 1400 is turned off or otherwise loses power.

Information, including instructions for automatically verifying road closure reports, is provided to the bus 1410 for use by the processor from an external input device 1412, such as a keyboard containing alphanumeric keys operated by a human user, or a sensor. A sensor detects conditions in its vicinity and transforms those detections into physical expression compatible with the measurable phenomenon used to represent information in computer system 1400. Other external devices coupled to bus 1410, used primarily for interacting with humans, include a display device 1414, such as a cathode ray tube (CRT) or a liquid crystal display (LCD), or plasma screen or printer for presenting text or images, and a pointing device 1416, such as a mouse or a trackball or cursor direction keys, or motion sensor, for controlling a position of a small cursor image presented on the display 1414 and issuing commands associated with graphical elements presented on the display 1414. In some embodiments, for example, in embodiments in which the computer system 1400 performs all functions automatically without human input, one or more of external input device 1412, display device 1414 and pointing device 1416 is omitted.

In the illustrated embodiment, special purpose hardware, such as an application specific integrated circuit (ASIC) 1420, is coupled to bus 1410. The special purpose hardware is configured to perform operations not performed by processor 1402 quickly enough for special purposes. Examples of application specific ICs include graphics accelerator cards for generating images for display 1414, cryptographic boards for encrypting and decrypting messages sent over a network, speech recognition, and interfaces to special external devices, such as robotic arms and medical scanning equipment that repeatedly perform some complex sequence of operations that are more efficiently implemented in hardware.

Computer system 1400 also includes one or more instances of a communications interface 1470 coupled to bus 1410. Communication interface 1470 provides a one-way or two-way communication coupling to a variety of external devices that operate with their own processors, such as printers, scanners and external disks. In general the coupling is with a network link 1478 that is connected to a local network 1480 to which a variety of external devices with their own processors are connected. For example, communication interface 1470 may be a parallel port or a serial port or a universal serial bus (USB) port on a personal computer. In some embodiments, communications interface 1470 is an integrated services digital network (ISDN) card or a digital subscriber line (DSL) card or a telephone modem that provides an information communication connection to a corresponding type of telephone line. In some embodiments, a communication interface 1470 is a cable modem that converts signals on bus 1410 into signals for a communication connection over a coaxial cable or into optical signals for a communication connection over a fiber optic cable. As another example, communications interface 1470 may be a local area network (LAN) card to provide a data communication connection to a compatible LAN, such as Ethernet. Wireless links may also be implemented. For wireless links, the communications interface 1470 sends or receives or both sends and receives electrical, acoustic or electromagnetic signals, including infrared and optical signals, that carry information streams, such as digital data. For example, in wireless handheld devices, such as mobile telephones like cell phones, the communications interface 1470 includes a radio band electromagnetic transmitter and receiver called a radio transceiver. In certain embodiments, the communications interface 1470 enables connection to the communication network 117 for automatically verifying road closure reports.

The term computer-readable medium is used herein to refer to any medium that participates in providing information to processor 1402, including instructions for execution. Such a medium may take many forms, including, but not limited to, non-volatile media, volatile media and transmission media. Non-volatile media include, for example, optical or magnetic disks, such as storage device 1408. Volatile media include, for example, dynamic memory 1404. Transmission media include, for example, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, any other memory chip or cartridge, a carrier wave, or any other medium from which a computer can read.

FIG. 15 illustrates a chip set 1500 upon which an embodiment of the invention may be implemented. Chip set 1500 is programmed to automatically verify road closure reports as described herein and includes, for instance, the processor and memory components described with respect to FIG. 14 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set can be implemented in a single chip.

In one embodiment, the chip set 1500 includes a communication mechanism such as a bus 1501 for passing information among the components of the chip set 1500. A processor 1503 has connectivity to the bus 1501 to execute instructions and process information stored in, for example, a memory 1505. The processor 1503 may include one or more processing cores with each core configured to perform independently. A multi-core processor enables multiprocessing within a single physical package. Examples of a multi-core processor include two, four, eight, or greater numbers of processing cores. Alternatively or in addition, the processor 1503 may include one or more microprocessors configured in tandem via the bus 1501 to enable independent execution of instructions, pipelining, and multithreading. The processor 1503 may also be accompanied with one or more specialized components to perform certain processing functions and tasks such as one or more digital signal processors (DSP) 1507, or one or more application-specific integrated circuits (ASIC) 1509. A DSP 1507 typically is configured to process real-world signals (e.g., sound) in real time independently of the processor 1503. Similarly, an ASIC 1509 can be configured to performed specialized functions not easily performed by a general purposed processor. Other specialized components to aid in performing the inventive functions described herein include one or more field programmable gate arrays (FPGA) (not shown), one or more controllers (not shown), or one or more other special-purpose computer chips.

The processor 1503 and accompanying components have connectivity to the memory 1505 via the bus 1501. The memory 1505 includes both dynamic memory (e.g., RAM, magnetic disk, writable optical disk, etc.) and static memory (e.g., ROM, CD-ROM, etc.) for storing executable instructions that when executed perform the inventive steps described herein to automatically verify road closure reports. The memory 1505 also stores the data associated with or generated by the execution of the inventive steps.

Figure 16:
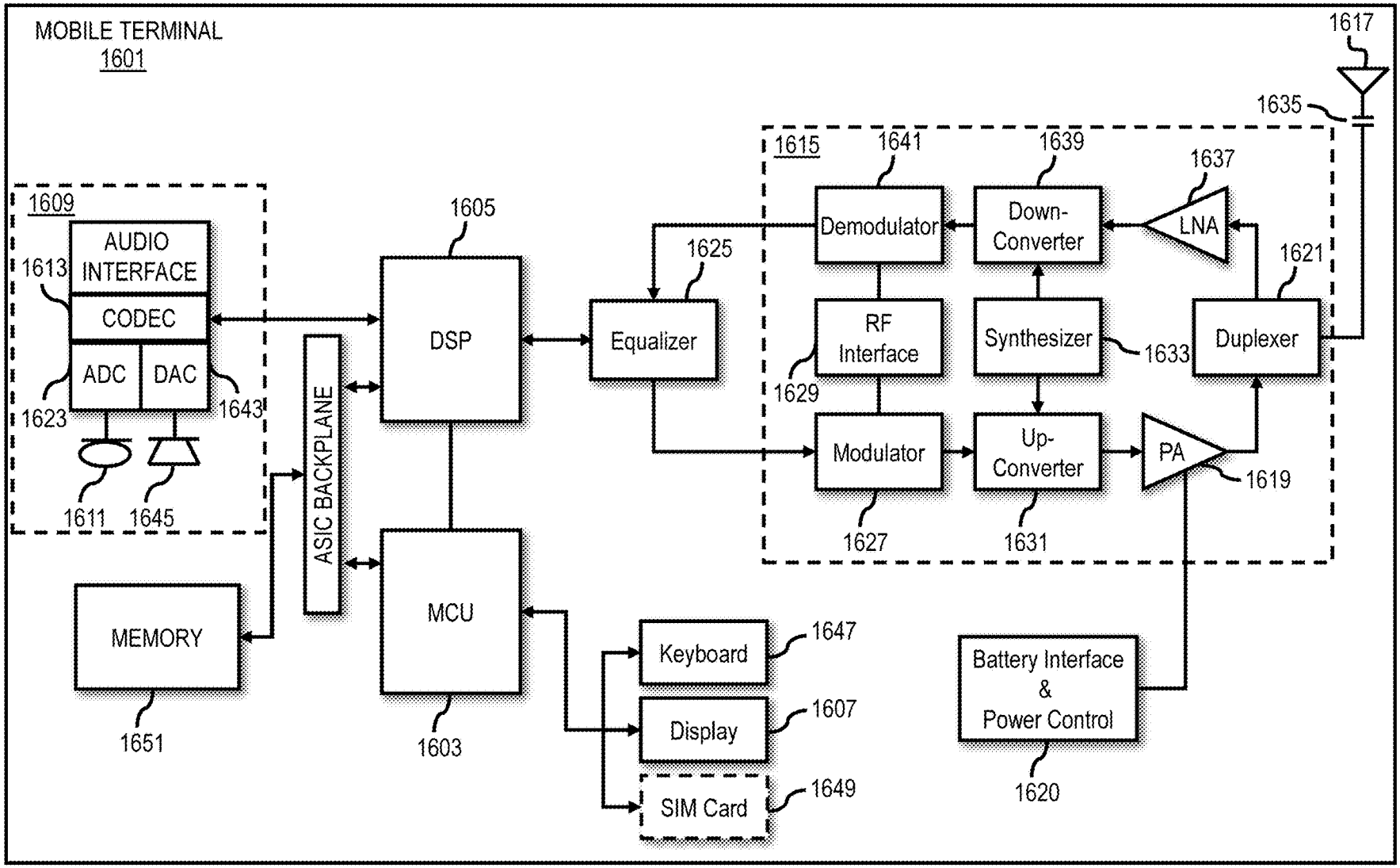
FIG. 16 is a diagram of a mobile terminal (e.g., handset or vehicle or part thereof) that can be used to implement an embodiment.

FIG. 16 is a diagram of exemplary components of a mobile terminal (e.g., a component associated with or embedded in the vehicle 113) capable of operating in the system of FIG. 1, according to one embodiment. Generally, a radio receiver is often defined in terms of front-end and back-end characteristics. The front-end of the receiver encompasses all of the Radio Frequency (RF) circuitry whereas the back-end encompasses all of the base-band processing circuitry. Pertinent internal components of the telephone include a Main Control Unit (MCU) 1603, a Digital Signal Processor (DSP) 1605, and a receiver/transmitter unit including a microphone gain control unit and a speaker gain control unit. A main display unit 1607 provides a display to the user in support of various applications and mobile station functions that offer automatic contact matching. An audio function circuitry 1609 includes a microphone 1611 and microphone amplifier that amplifies the speech signal output from the microphone 1611. The amplified speech signal output from the microphone 1611 is fed to a coder/decoder (CODEC) 1613.

A radio section 1615 amplifies power and converts frequency in order to communicate with a base station, which is included in a mobile communication system, via antenna 1617. The power amplifier (PA) 1619 and the transmitter/modulation circuitry are operationally responsive to the MCU 1603, with an output from the PA 1619 coupled to the duplexer 1621 or circulator or antenna switch, as known in the art. The PA 1619 also couples to a battery interface and power control unit 1620.

In use, a user of mobile station 1601 speaks into the microphone 1611 and his or her voice along with any detected background noise is converted into an analog voltage. The analog voltage is then converted into a digital signal through the Analog to Digital Converter (ADC) 1623. The control unit 1603 routes the digital signal into the DSP 1605 for processing therein, such as speech encoding, channel encoding, encrypting, and interleaving. In one embodiment, the processed voice signals are encoded, by units not separately shown, using a cellular transmission protocol such as global evolution (EDGE), general packet radio service (GPRS), global system for mobile communications (GSM), Internet protocol multimedia subsystem (IMS), universal mobile telecommunications system (UNITS), etc., as well as any other suitable wireless medium, e.g., microwave access (WiMAX), Long Term Evolution (LTE) networks, code division multiple access (CDMA), wireless fidelity (WiFi), satellite, and the like.

The encoded signals are then routed to an equalizer 1625 for compensation of any frequency-dependent impairments that occur during transmission though the air such as phase and amplitude distortion. After equalizing the bit stream, the modulator 1627 combines the signal with a RF signal generated in the RF interface 1629. The modulator 1627 generates a sine wave by way of frequency or phase modulation. In order to prepare the signal for transmission, an up-converter 1631 combines the sine wave output from the modulator 1627 with another sine wave generated by a synthesizer 1633 to achieve the desired frequency of transmission. The signal is then sent through a PA 1619 to increase the signal to an appropriate power level. In practical systems, the PA 1619 acts as a variable gain amplifier whose gain is controlled by the DSP 1605 from information received from a network base station. The signal is then filtered within the duplexer 1621 and optionally sent to an antenna coupler 1635 to match impedances to provide maximum power transfer. Finally, the signal is transmitted via antenna 1617 to a local base station. An automatic gain control (AGC) can be supplied to control the gain of the final stages of the receiver. The signals may be forwarded from there to a remote telephone which may be another cellular telephone, other mobile phone or a land-line connected to a Public Switched Telephone Network (PSTN), or other telephony networks.

Voice signals transmitted to the mobile station 1601 are received via antenna 1617 and immediately amplified by a low noise amplifier (LNA) 1637. A down-converter 1639 lowers the carrier frequency while the demodulator 1641 strips away the RF leaving only a digital bit stream. The signal then goes through the equalizer 1625 and is processed by the DSP 1605. A Digital to Analog Converter (DAC) 1643 converts the signal and the resulting output is transmitted to the user through the speaker 1645, all under control of a Main Control Unit (MCU) 1603—which can be implemented as a Central Processing Unit (CPU) (not shown).

The MCU 1603 receives various signals including input signals from the keyboard 1647. The keyboard 1647 and/or the MCU 1603 in combination with other user input components (e.g., the microphone 1611) comprise a user interface circuitry for managing user input. The MCU 1603 runs a user interface software to facilitate user control of at least some functions of the mobile station 1601 to automatically verify road closure reports. The MCU 1603 also delivers a display command and a switch command to the display 1607 and to the speech output switching controller, respectively. Further, the MCU 1603 exchanges information with the DSP 1605 and can access an optionally incorporated SIM card 1649 and a memory 1651. In addition, the MCU 1603 executes various control functions required of the station. The DSP 1605 may, depending upon the implementation, perform any of a variety of conventional digital processing functions on the voice signals. Additionally, DSP 1605 determines the background noise level of the local environment from the signals detected by microphone 1611 and sets the gain of microphone 1611 to a level selected to compensate for the natural tendency of the user of the mobile station 1601.

The CODEC 1613 includes the ADC 1623 and DAC 1643. The memory 1651 stores various data including call incoming tone data and is capable of storing other data including music data received via, e.g., the global Internet. The software module could reside in RAM memory, flash memory, registers, or any other form of writable computer-readable storage medium known in the art including non-transitory computer-readable storage medium. For example, the memory device 1651 may be, but not limited to, a single memory, CD, DVD, ROM, RAM, EEPROM, optical storage, or any other non-volatile or non-transitory storage medium capable of storing digital data.

An optionally incorporated SIM card 1649 carries, for instance, important information, such as the cellular phone number, the carrier supplying service, subscription details, and security information. The SIM card 1649 serves primarily to identify the mobile station 1601 on a radio network. The card 1649 also contains a memory for storing a personal telephone number registry, text messages, and user specific mobile station settings.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A computer-implemented method for automatically verifying a road closure report comprising:

receiving the road closure report pertaining to one or more road links;

constructing a closure link graph comprising a connected set of road links indicated in the road closure report;

processing one or more features of probe data collected from a plurality of vehicles traveling on the connected set of road links, wherein the processing includes, receiving a first probe point and a second probe point from at least one vehicle, determining that a time difference between the first probe point and the second probe point is more than a pre-determined threshold, and replacing the first probe point with the second probe point; and evaluating a closure probability in the one or more road links indicated by the road closure report based on the one or more features.

2. The method of claim 1, wherein the one or more features indicate historical confidence level pertaining to source of the road closure report, temporal or spatial variances in the probe data, or a combination thereof.

3. The method of claim 1, wherein constructing the closure link graph further comprising:

determining the connected set of road links is unordered with respect to a spatial arrangement; and arranging the unordered set of road links by matching an end node of at least one road link to a beginning node of at least one closest road link based on location information.

4. The method of claim 3, further comprising:

adding one or more upstream links to the connected set of road links, one or more downstream links from the connected set of road links, or a combination thereof, wherein the one or more upstream links, the one or more downstream links, or a combination thereof are open to traffic.

5. The method of claim 1, further comprising:

retrieving another probe point as the second probe point to iteratively evaluate the time difference;

determining that the time difference between the first probe point and the second probe point is less than the pre-determined threshold; and constructing a vehicle path from the first probe point to the second probe point, wherein constructing the vehicle path comprises processing all probe points collected for the at least one vehicle.

6. The method of claim 4, further comprising:

constructing a superlink by aggregating the connected set of road links, the probe data collected from a plurality of vehicles traveling on the connected set of road links, or a combination thereof, wherein the superlink includes an ordered set of road links that indicates at least one vehicle travelling through a road link in the superlink also travels through another road link of the same superlink.

7. The method of claim 6, further comprising:

constructing the superlink by aggregating the one or more upstream links, the one or more downstream links, or a combination thereof.

8. The method of claim 1, wherein the road closure report includes a direct indication of a road link ID corresponding to a roadway affected by the reported road closure or an indirect indication that specifies an address or an offset location of the road link affected by the reported road closure that is map-matched or translated to corresponding links.

9. An apparatus for automatically verifying a road closure report comprising:

at least one processor; and at least one memory including computer program code for one or more programs, the at least one memory and the computer program code configured to, with the at least one processor, cause the apparatus to perform at least the following, receive the road closure report pertaining to one or more road links;

construct a closure link graph comprising a connected set of road links indicated in the road closure report;

process one or more features of probe data collected from a plurality of vehicles traveling on the connected set of road links, wherein the process includes, receive a first probe point and a second probe point from at least one vehicle, determine that a time difference between the first probe point and the second probe point is more than a pre-determined threshold, and replace the first probe point with the second probe point; and evaluate a closure probability in the one or more road links indicated by the road closure report based on the one or more features.

10. The apparatus of claim 9, wherein the one or more features indicate historical confidence level pertaining to source of the road closure report, temporal or spatial variances in the probe data, or a combination thereof.

11. The apparatus of claim 9, wherein constructing the closure link graph further comprising:

determine the connected set of road links is unordered with respect to a spatial arrangement; and arrange the unordered set of road links by matching an end node of at least one road link to a beginning node of at least one closest road link based on location information.

12. The apparatus of claim 11, wherein the apparatus is further caused to perform at least the following:

add one or more upstream links to the connected set of road links, one or more downstream links from the connected set of road links, or a combination thereof, wherein the one or more upstream links, the one or more downstream links, or a combination thereof are open to traffic.

13. The apparatus of claim 9, wherein the apparatus is further caused to perform at least the following:

retrieve another probe point as the second probe point to iteratively evaluate the time difference;

determine that the time difference between the first probe point and the second probe point is less than the pre-determined threshold; and construct a vehicle path from the first probe point to the second probe point, wherein constructing the vehicle path comprises processing all probe points collected for the at least one vehicle.

14. The apparatus of claim 12, wherein the apparatus is further caused to perform at least the following:

construct a superlink by aggregating the connected set of road links, the probe data collected from a plurality of vehicles traveling on the connected set of road links, or a combination thereof, wherein the superlink includes an ordered set of road links that indicates at least one vehicle travelling through a road link in the superlink also travels through another road link of the same superlink.

15. The apparatus of claim 14, wherein the apparatus is further caused to perform at least the following:

construct the superlink by aggregating the one or more upstream links, the one or more downstream links, or a combination thereof.

16. A non-transitory computer-readable storage medium for automatically verifying a road closure report, carrying one or more sequences of one or more instructions which, when executed by one or more processors, cause an apparatus to perform:

receiving the road closure report pertaining to one or more road links;

constructing a closure link graph comprising a connected set of road links indicated in the road closure report, wherein the constructing includes, determining the connected set of road links is unordered with respect to a spatial arrangement, and arranging the unordered set of road links by matching an end node of at least one road link to a beginning node of at least one closest road link based on location information;

adding one or more upstream links to the connected set of road links, one or more downstream links from the connected set of road links, or a combination thereof, wherein the one or more upstream links, the one or more downstream links, or a combination thereof are open to traffic;

constructing a superlink by aggregating the connected set of road links, the probe data collected from a plurality of vehicles traveling on the connected set of road links, or a combination thereof, wherein the superlink includes an ordered set of road links that indicates at least one vehicle travelling through a road link in the superlink also travels through another road link of the same superlink;

processing one or more features of probe data collected from a plurality of vehicles traveling on the connected set of road links; and evaluating a closure probability in the one or more road links indicated by the road closure report based on the one or more features.

17. The non-transitory computer-readable storage medium of claim 16, wherein the one or more features indicate historical confidence level pertaining to source of the road closure report, temporal or spatial variances in the probe data, or a combination thereof.

18. The non-transitory computer-readable storage medium of claim 16, the processing of the one or more features further comprising:

constructing the superlink by aggregating the one or more upstream links, the one or more downstream links, or a combination thereof.

19. The non-transitory computer-readable storage medium of claim 16, the processing of the one or more features further comprising:

receiving a first probe point and a second probe point from at least one vehicle;

determining that a time difference between the first probe point and the second probe point is more than a pre-determined threshold; and replacing the first probe point with the second probe point.

20. The non-transitory computer-readable storage medium of claim 19, wherein the apparatus is further caused to perform:

retrieving another probe point as the second probe point to iteratively evaluate the time difference;

determining that the time difference between the first probe point and the second probe point is less than the pre-determined threshold; and constructing a vehicle path from the first probe point to the second probe point, wherein constructing the vehicle path comprises processing all probe points collected for the at least one vehicle.

* * * * *